US012663231B2

(12) United States Patent
Thiesen et al.

(10) Patent No.: US 12,663,231 B2
(45) Date of Patent: Jun. 23, 2026

(54) ELECTRONIC FIRE CONTROL SYSTEM AND METHODS OF OPERATING THE SAME

(71) Applicant: Biofire Technologies Inc., Broomfield, CO (US)

(72) Inventors: Jack Hugo Thiesen, Firestone, CO (US); Kai Thorin Kloepfer, Denver, CO (US); Karl Fredrick Brakora, Spring Lake, MI (US); Christopher James Owens, Denver, CO (US)

(73) Assignee: Biofire Technologies Inc., Broomfield, CO (US)

( * ) Notice: Subject to any disclaimer, the term of this patent is extended or adjusted under 35 U.S.C. 154(b) by 0 days.

(21) Appl. No.: 18/965,661

(22) Filed: Dec. 2, 2024

(65) Prior Publication Data

US 2025/0093118 A1 Mar. 20, 2025

Related U.S. Application Data

(62) Division of application No. 17/664,376, filed on May 20, 2022, now Pat. No. 12,158,318.

(60) Provisional application No. 63/190,948, filed on May 20, 2021.

(51) Int. Cl.
*F41A 19/59* (2006.01)

(52) U.S. Cl.
CPC ..... *F41A 19/59* (2013.01)

(58) Field of Classification Search
CPC ..... F41A 19/58; F41A 19/59; F41A 19/60; F41A 19/61; F41A 19/62; F41A 19/63; F41A 19/70; F41A 19/69; G01R 29/24
USPC ..... 42/69.01
See application file for complete search history.

(56) References Cited

U.S. PATENT DOCUMENTS 2,780,882 A * 2/1957 Temple ..... F41A 19/58 89/135
3,738,043 A * 6/1973 Green ..... F41A 19/58 42/84
4,009,536 A * 3/1977 Wolff ..... F41A 19/59 89/135
4,275,521 A * 6/1981 Gerstenberger ..... F41A 19/58 42/84

(Continued)

FOREIGN PATENT DOCUMENTS

CA 3066787 A1 * 4/2019 ..... H02J 7/345
WO 2016070254 A1 5/2016

*Primary Examiner* — John Cooper
(74) *Attorney, Agent, or Firm* — Perkins Coie LLP; Andrew T. Pettit

(57) ABSTRACT

The present disclosure provides systems and techniques that can be implemented in a gun, such as an electromechanical gun. The gun may charge a capacitor bank, identify a trigger break based on an output generated by a trigger sensor, and transmit a signal based on the trigger break. Transmitting the signal may result in the capacitor bank discharging electric charge such that electric current is directed at an actuator mechanism so as to cause displacement of the actuator mechanism, and the displacement of the actuator mechanism may result in the propulsion of a projectile through a barrel of the gun. The gun may determine that a projectile has been fired based on an output of an accelerometer or a gyroscope, and the gun may recharge the capacitor bank in response to determining that the projectile has been fired.

14 Claims, 14 Drawing Sheets

(56) References Cited

U.S. PATENT DOCUMENTS

| | | | | | |
|---|---|---|---|---|---|
| 4,329,803 | A * | 5/1982 | Johnson | F41A 19/58 | 42/84 |
| 4,700,263 | A | 10/1987 | Marshall et al. | | |
| 5,721,391 | A | 2/1998 | Thorsted et al. | | |
| 5,974,940 | A * | 11/1999 | Madni | F41G 3/22 | 89/41.17 |
| RE38,794 | E * | 9/2005 | Danner | F41A 19/70 | 42/84 |
| 8,578,922 | B1 * | 11/2013 | Granger | F41B 11/723 | 124/71 |
| 2005/0257676 | A1 | 11/2005 | Ealovega | | |
| 2007/0137470 | A1 * | 6/2007 | Oertwig | F41A 19/58 | 42/84 |
| 2014/0145513 | A1 | 5/2014 | Kapoor et al. | | |
| 2019/0281259 | A1 | 9/2019 | Palazzolo | | |

* cited by examiner

100

800

900

1100

1200

1400

ELECTRONIC FIRE CONTROL SYSTEM AND METHODS OF OPERATING THE SAME

CROSS-REFERENCE TO RELATED APPLICATIONS

This application is a divisional of U.S. application Ser. No. 17/664,376, titled "FIRE CONTROL FOR AN ELECTROMECHANICAL GUN" and filed May 20, 2022, now U.S. Pat. No. 12,158,318, which claims the benefit of priority to U.S. Provisional Application No. 63/190,948, titled "FIRE CONTROL FOR AN ELECTROMECHANICAL GUN" and filed on May 20, 2021, which are incorporated by reference herein in their entireties.

FIELD OF TECHNOLOGY

The teachings disclosed herein generally relate to guns, and more specifically to fire control systems of guns.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems and techniques described herein support operating an electronic fire control system, which may be implemented in a gun. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the systems and devices described herein provide an electronic fire control system that may be implemented in a gun. The gun may charge a capacitor bank, identify a trigger break based on an output generated by a trigger sensor, and transmit a signal based on the trigger break. Transmitting the signal may result in the capacitor bank discharging electric charge into an actuator mechanism to cause displacement of the actuator mechanism, and the displacement of the actuator mechanism may result in propulsion of a projectile through a barrel of the gun. For example, the actuator mechanism may be configured to retain a firing mechanism (e.g., a sear, a striker, a hammer, etc.), and displacing the actuator mechanism may result in release of the firing mechanism. The gun may determine that a projectile has been fired based on an output of an accelerometer, a gyroscope, or another device that is able to measure the magnitude, direction, velocity, or acceleration of motion of the gun, and the gun may recharge the capacitor bank in response to determining that the projectile has been fired.

Figure 1:
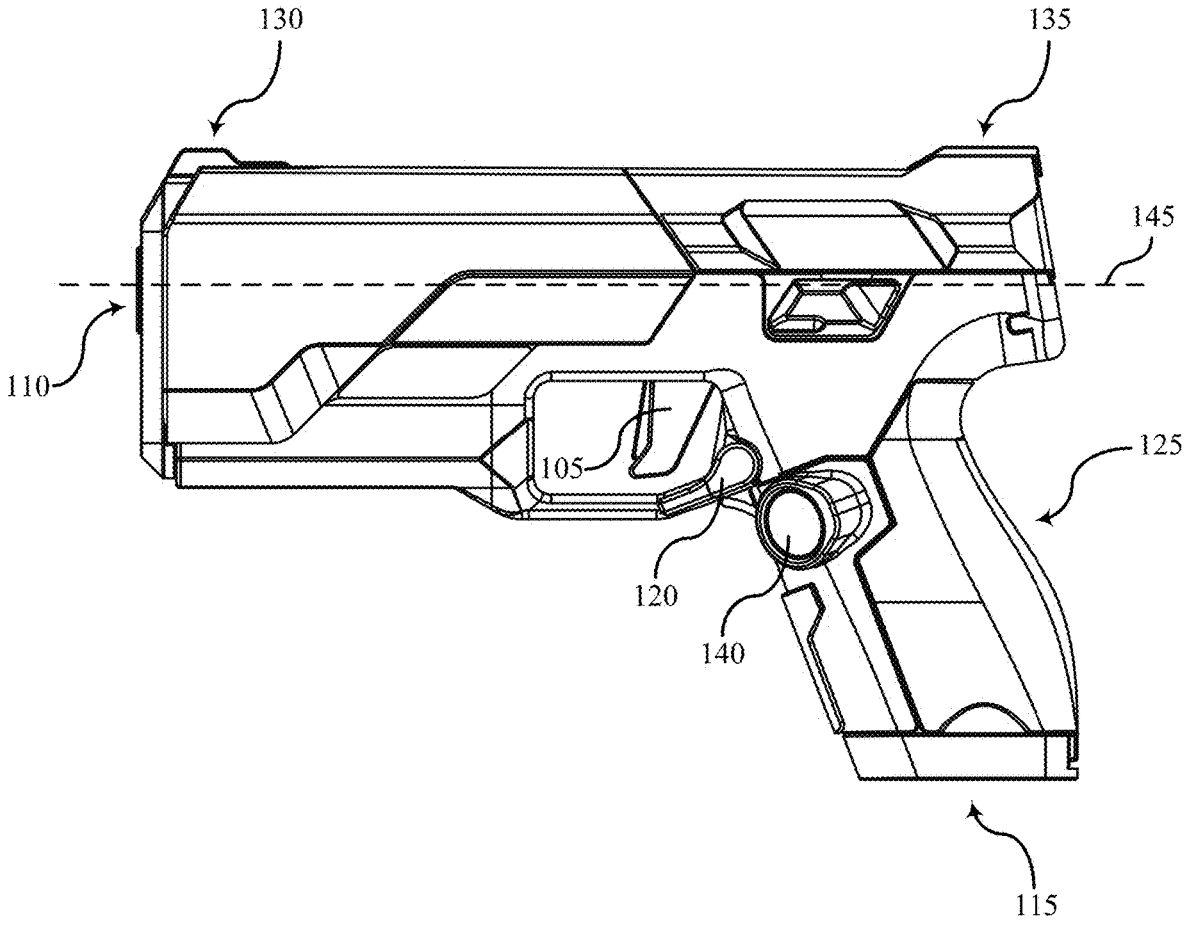
FIG. 1 illustrates an example of a gun that includes an electronic fire control system.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

Conventional guns rely on a mechanical fire control system to facilitate operation of the gun. Conventional fire control systems generally include a sear that is configured to retain a striker, hammer, or bolt until the correct amount pressure is applied to the trigger, at which point the striker, hammer, or bolt is released, causing the firing pin to collide with the cartridge primer cap, ignite a propellant, and propel a projectile through the barrel of the gun. Such mechanical fire control systems lack safety features that prevent unauthorized use of the gun by a thief.

Some conventional guns include an inhibitor mechanism that is meant to prevent unauthorized use of the gun. But inhibition-based guns—namely, guns that engage an inhibitor mechanism to inhibit movement of a component (such as a trigger) while the gun is unarmed and disengage the inhibitor mechanism to arm the gun—utilize a holding current to either engage the inhibitor mechanism while the gun is unarmed or to disengage the inhibitor mechanism while the gun is armed. In either case, the holding current may be present for hours or days at a time, thereby resulting in a significant power drain and reducing the amount of time for which the gun can be used. Additionally, an inhibitor mechanism can often be defeated by simply removing the inhibitor mechanism from the gun. For example, an inhibition-based gun may include a bar that inhibits (or simply blocks) movement of the trigger while the gun is unarmed, and a holding current may be used to hold the bar in a different location such that the trigger is not inhibited by the bar while the gun is armed, allowing the mechanical fire control system of the gun to function as normal while armed. But if a thief steals the gun and removes the inhibitor mechanism, then the gun loses the safety benefits originally provided by the inhibitor mechanism. As such, conventional fire control systems fail to provide adequate safety features.

Introduced here, therefore, are reliable and low latency fire control systems that improve gun safety. The fire control systems described herein may be implemented in a gun to improve the safety and reliability of the gun. An electronic fire control system may include a battery, a capacitor bank, an actuator mechanism, and electronic circuitry. The electronic circuitry facilitates the selective discharge of electric charge from the capacitor bank into the actuator mechanism, thereby activating the actuator mechanism and causing the gun to fire. The electronic circuit that facilitates the selective discharge of electric charge may be referred to as a "controller." The electronic circuitry may include analog components that support the functioning of the fire control system in a low latency manner. Also, the use of analog components mitigates the potential presence of software bugs, thereby enhancing the reliability of the gun.

The electronic circuitry may assert an activation signal to arm the gun such that the gun is capable of being firing a projectile, identify a trigger break based on a trigger sensor of the electrical circuitry, and assert a trigger signal to indicate the trigger break. The capacitor bank may discharge electric charge in response to the assertion of the trigger signal and cause the gun to fire. The electric charge may be directed at the actuator mechanism to cause activation of the actuator mechanism. As an illustrative example, the actuator mechanism may retain a firing mechanism (e.g., a firing pin, a sear, a hammer, a striker, etc.), and the electric charge can be directed from the capacitor bank to an activation element (e.g., a solenoid, a piezoelectric element, an electronic element, etc.) of the actuator mechanism to cause displacement of the actuator mechanism and release the firing mechanism such that the firing mechanism collides with a cartridge and causes ignition of the cartridge propellant.

Embodiments may be described in the context of signals or executable instructions for the purpose of illustration. For example, a controller housed in a gun may be described as being capable of may generating signals that permit firing of projectiles from the gun. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that includes an electronic fire control system in accordance with aspects of the present disclosure. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly appliable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an inertial measurement unit (IMU) configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint sensor (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to described data that is used to authenticate a user. For example, the gun 100 may collect authentication data from the user to determine that the user is authorized to operate the gun 100, and the gun 100 may be unlocked in based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights—namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

The gun 100 may charge a capacitor bank, identify a trigger break based on an output generated by a trigger sensor, and transmit a signal based on the trigger break. The trigger sensor may be located proximate to the trigger 105, and the output may indicate that the trigger 105 has satisfied a displacement threshold and/or a force threshold. The trigger sensor may be an example of a mechanical switch, a Hall effect sensor, a laser proximity sensor, a pressure sensor, a load cell, or the like. The trigger sensor may be configured to determine whether trigger movement satisfies a displacement threshold and/or a force threshold, and the trigger sensor may generate the output to indicate that the trigger movement satisfies the displacement threshold and/or force threshold.

Transmitting the signal may include generating a signal, such as a high voltage signal or a low voltage signal. For example, a first analog electronic component (e.g., a first flip-flop) may generate a signal, the signal may be directed through a logic gate via a physical conductive medium, and a second analog component (e.g., a second flip-flop) may receive the signal via the physical conductive medium. Transmitting the signal may result in the capacitor bank discharging electric charge into an actuator mechanism so as to cause displacement of the actuator mechanism, and the displacement of the actuator mechanism may result in propulsion of a projectile through the barrel 110. The signal may be an output of a controller or an aspect thereof, such as a flip-flop, a logic gate, or an electrical circuit, and the signal may cause the capacitor bank to discharge electric charge. Electric current may be directed from the capacitor bank to a solenoid or a piezo-electric element of the actuator mechanism so as to cause displacement of the actuator mechanism. The gun 100 may determine that a projectile has been fired based on an output of an accelerometer or a gyroscope, and the gun 100 may recharge the capacitor bank in response to determining that the projectile has been fired.

Figure 2:
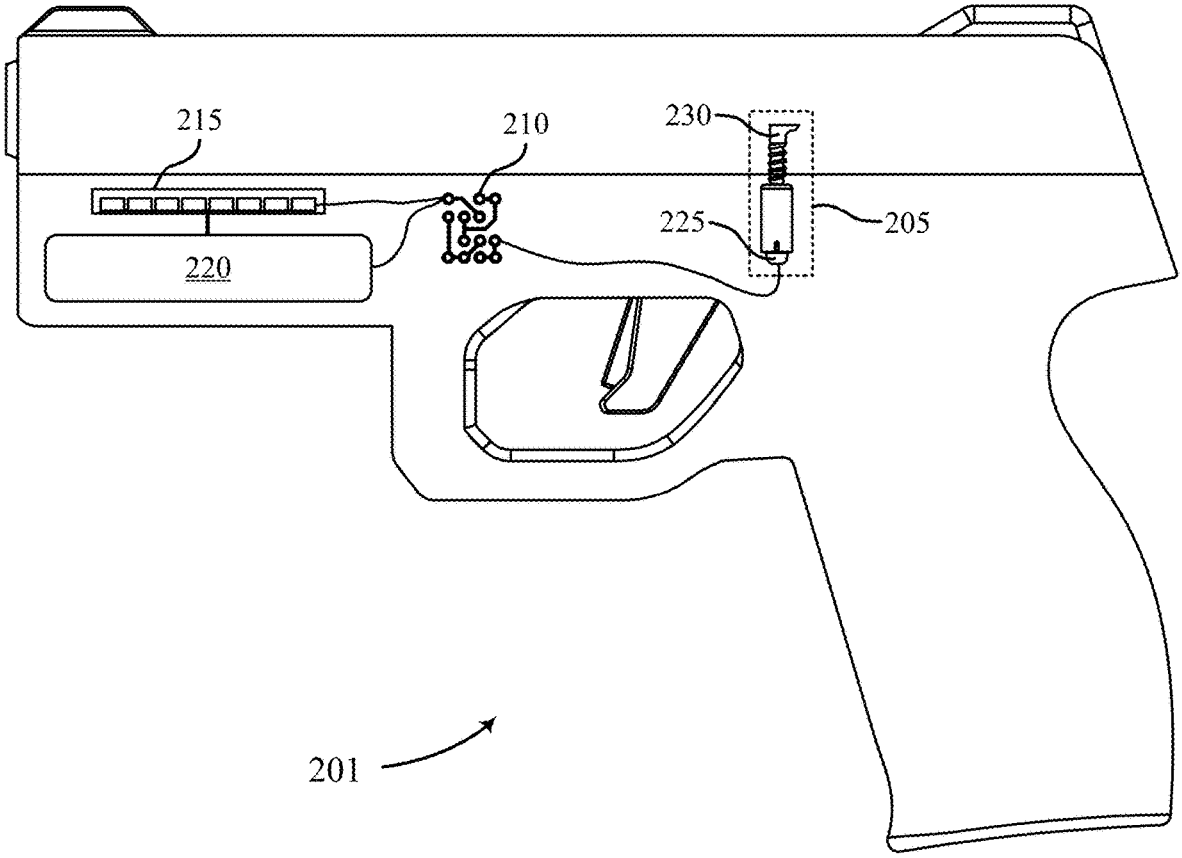
FIG. 2 illustrates an example of a gun that includes an electronic fire control system.

FIG. 2 illustrates an example of gun 201 that includes an electronic fire control system. The gun 201 includes an actuator mechanism 205, a controller 210, a capacitor bank 215, and an energy store 220 (e.g., a battery cell, a battery pack, etc.). The actuator mechanism 205 includes an electronic component 225 (e.g., a solenoid, a piezo-electric element, etc.) and a mechanical component 230 (e.g., an actuator block, a firing mechanism retention and release component, a conductive firing pin, etc.).

The controller 210 may implement fire control logic to arm the gun 201, disarm the gun 201, and cause the gun 201 to fire a projectile. The gun 201 may be capable of firing projectiles while armed and incapable of firing projectiles while disarmed. The controller 210 may include analog and/or digital electronic components. In some examples, the controller 210 may include analog components to reduce system latency and mitigate the possible introduction of software bugs into the fire control system. For example, the controller 210 may include analog components, such as diodes, transistors, resistors, capacitors, logic gates, flip-flops, integrators, comparators, or the like. Implementing aspects of the controller 210 in analog components creates a robust, reliable, and low-latency fire control system.

The controller 210 may cause the energy store 220 to charge the capacitor bank 215 with electric charge. The controller 210 may monitor the capacitor bank 215, determine that a stored voltage of the capacitor back exceeds a threshold voltage, and transmit a stasis signal indicating that the capacitor bank is charged based on the stored voltage exceeding the threshold voltage.

The controller 210 may identify a trigger break using a trigger sensor (e.g., a Hall effect sensor, a load cell, a photointerrupter sensor, etc.). For example, the trigger sensor may generate an output indicating an amount of trigger movement or an amount of trigger force, and the controller 210 may identify the trigger break in response to determining that the output satisfies a trigger threshold (e.g., a displacement threshold and/or a force threshold). The controller 210 may transmit a signal in response to identifying the trigger break, and the signal may cause the capacitor bank 215 to discharge electric charge into the actuator mechanism 205. For example, the electric charge may be directed through the electronic component 225, which may be an example of a solenoid. Directing the electric charge through the electronic component 225 may create an electromagnetic field, and the electromagnetic field may cause displacement of the mechanical component 230. The mechanical component 230 may be an example of an actuator block, and the mechanical component 230 may be configured to retain a firing mechanism (e.g., a striker, a hammer, a sear, a sear linkage, a firing pin, etc.) by default and release the firing mechanism when displaced as a result of the electromagnetic field. Releasing the firing mechanism may result in ignition of a cartridge propellant and propulsion of a projectile through the barrel of the gun 201.

Figure 3:
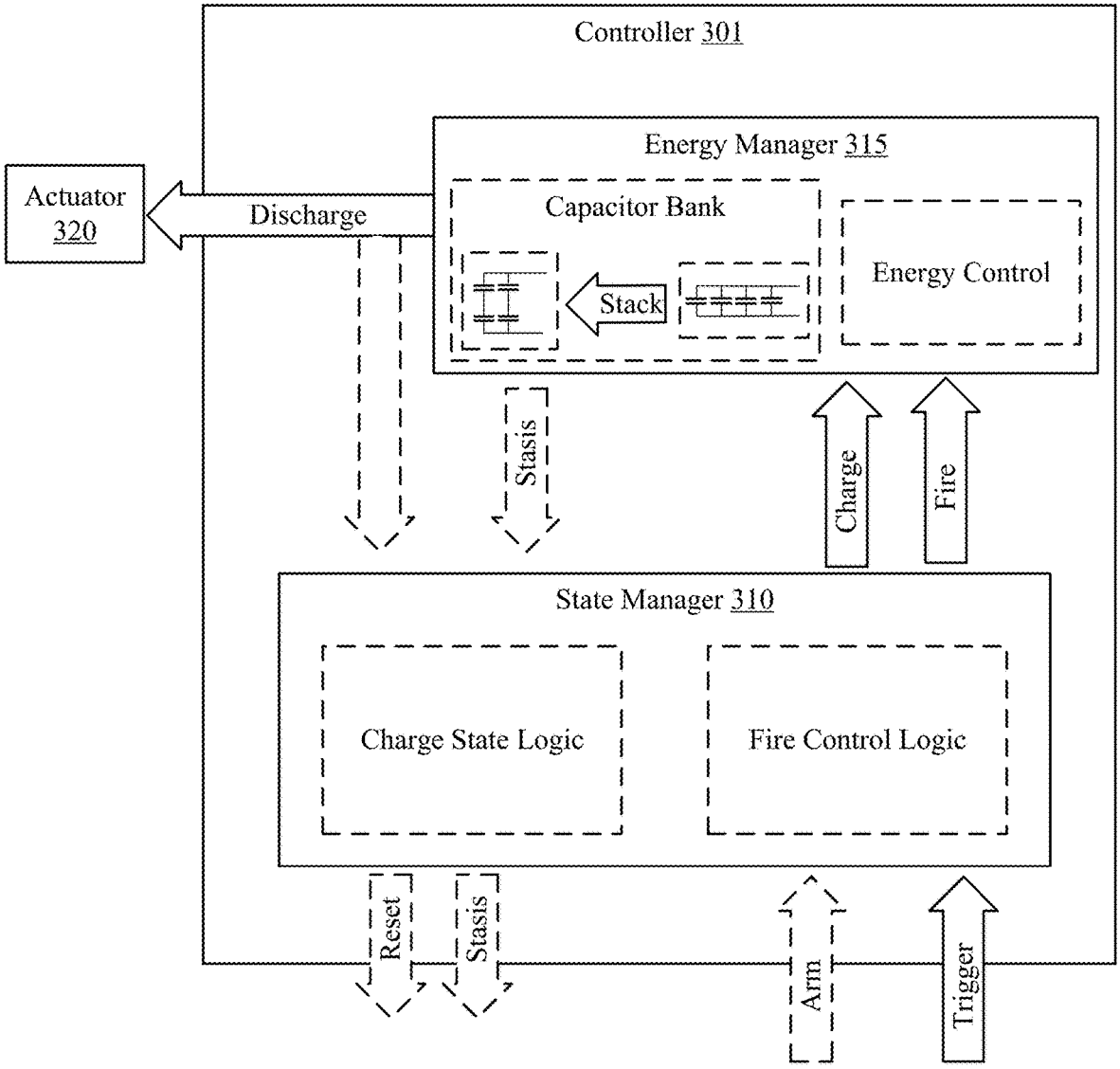
FIG. 3 illustrates an example of controller that can be used to selectively fire projectiles.

FIG. 3 illustrates an example of a controller 301 that capable of managing a fire control system to selectively fire projectiles, such as bullets, from a gun. The controller 301 may be an example or component of a gun described herein. In some examples, the controller 301 may be located inside a chassis (e.g., a frame) of the gun, and the controller 301 may be potted inside the chassis to improve thermal performance and resistance to contaminants (e.g., water, carbon fouling, soot, dirt, etc.).

The controller 301 includes a state manager 310 and an energy manager 315. The controller 301 may be implemented in a gun, and the controller 301 may be electronically coupled with one or more actuators 320. The controller 301 may be configured to cause the gun to fire a projectile by discharging electric charge into an actuator 320. For example, the actuator 320 may be an example of an electronically activated actuator that releases a firing mechanism in response to the discharge of electric charge into the actuator 320.

The controller 301 may include analog circuitry and/or digital circuitry that supports managing a fire control system. The controller 301 may include physical components that manage and/or determine the state of the gun. In some examples, the state manager 310 may implement a state machine via circuitry and electronic components. For example, the state manager 310 may include flip-flops, diodes, and transistors that implement charge state logic and fire control logic. The charge state logic may facilitate the rapid and reliable charging of the capacitor bank, while the fire control logic may facilitate the firing of projectiles and transitioning between states, such as an armed state and a disarmed state. The fire control logic may prevent the gun from firing when in the disarmed state and allow the gun to fire when in the armed state. For example, the fire signal may cause the capacitor bank to discharge electric charge, and the fire control logic may include logic gates formed of diodes and transistors that inhibit the transmission of the fire signal while the gun is in the disarmed state. The gun may enter the disarmed state when a user is unauthorized to operate the gun, or the gun may enter the disarmed state when the user is not presently holding the gun. The charge state logic may additionally or alternatively inhibit charging the capacitor bank with electric charge while the gun is in the disarmed state.

The state manager 310 may identify an arm (e.g., activation) signal indicating that the gun is to be armed, and the state manager 310 may transmit a charge signal to the energy manager 315 based on the arm signal. The arm signal may be transmitted by a digital component (e.g., a processor) or an analog component (e.g., a flip-flop). For example, a processor may authenticate the identity of the user and transmit the arm signal to the state manager in response to authenticating the identity of the user. The energy manager 315 may use an energy store (e.g., a battery) to charge the capacitor bank, and the energy manager 315 may transmit a stasis signal to indicate that the capacitor bank is charged. In some examples, the stasis signal may be transmitted based on determining that a stored voltage of the capacitor bank exceeds a voltage threshold. The state manager 310 may transmit a stasis signal to a processor to indicate to the processor that the capacitor bank is charged.

The energy manager 315 may charge the capacitor bank while the capacitors of the capacitor bank are connected in parallel. The capacitor bank may include a plurality of capacitors (e.g., 6 capacitors, 8 capacitors, 10 capacitors, 12 capacitors, 14 capacitors, etc.), and the energy manager 315 may charge the capacitor bank until the stored voltage satisfies the threshold voltage. The stored voltage may indicate the voltage of the capacitor bank, and the threshold voltage may be a predetermined voltage indicating a full charge state for the capacitor bank. In some examples, the stored voltage and/or the threshold voltage may be scaled, thereby supporting charging the capacitor bank to dynamic or configurable voltage levels.

The energy manager 315 may transmit a stasis signal to the state manager 310 based on the stored voltage satisfying the threshold voltage, and the state manager 310 may transmit a stasis signal to a processor indicating that the capacitors are charged and in stasis. The energy control may charge the capacitor bank with low current (e.g., trickle charging) to maintain a voltage that satisfies the voltage threshold. For example, the energy control may use high current (e.g., current above a threshold, such as 500 milliamperes (mA), 1 ampere (A), 3 A, 5 A, etc.) to quickly charge the capacitor bank until the voltage condition is satisfied, and the energy control may use low current (e.g., current that offsets the self-discharge rate of the capacitor bank, current that is below a threshold, such as 100 mA, 10 mA, 1 mA, etc.) to maintain a voltage at the capacitor bank that satisfies the threshold voltage.

The state manager 310 may identify a trigger signal indicating that a trigger break has occurred, and the state manager 310 may transmit a fire signal to the energy manager 315 based on the trigger signal. In some examples, the fire signal may be further based on the arm signal. For example, the controller 301 may assert the arm signal based on a user being authenticated and/or actively holding the gun, the controller 301 may identify the trigger signal indicating that a trigger break has occurred, and the controller 301 may transmit the fire signal based on both the assertion of the arm signal and the identification of the trigger signal. As an illustrative example, analog electronic components may be arranged to create an AND logic gate, and the fire signal may be transmitted based on the AND logic gate receiving both the arm signal and the trigger signal.

The capacitor bank may discharge electric charge into the actuator 320 in response to the fire signal. In some examples, the capacitor bank may include a plurality of capacitors connected in parallel, and the controller 301 may stack the capacitors such that a first subset of capacitors is connected in series with a second subset of capacitors in response to the fire signal, and the electric charge may be discharged from the capacitor bank while the first subset of capacitors is connected in series with the second subset of capacitors. Stacking the capacitors approximately doubles the voltage of the capacitor bank, thereby increasing the power supplied by the capacitor bank and delivered to the actuator 320. The term "approximately double" may include a margin of 10 percent. For example, a first voltage may be considered to be approximately doubled to a second voltage when the second voltage is no more than 10 percent over twice the first voltage and no less than 10 percent below twice the first voltage.

Discharging the electric charge into the actuator 320 may cause displacement of the actuator 320 and result in release of a firing mechanism, such as a striker, hammer, or sear. Displacing the firing mechanism may cause a firing pin to collide with a primer cap, which may result ignition of propellant and propulsion of a projectile through a barrel of the gun. In other words, activating the actuator 320 may cause the gun to fire a bullet.

The state manager 310 may monitor the discharge of the capacitor bank and determine whether a discharge condition is satisfied. The state manager 310 may integrate the voltage of the capacitor bank during discharge and compare the integrated voltage to a threshold voltage. The integrated voltage and/or the threshold voltage may be scaled, and the discharge condition may be satisfied based on the integrated voltage reaching or exceeding the threshold voltage. The voltage of the capacitor bank may be integrated for a time duration, and if the integrated voltage does not meet or exceed the threshold voltage during the time duration, the state manager 310 may indicate a discharge error. The gun may transition to a disarmed state based on the discharge error. The state manager 310 may disarm the controller 301 (e.g., unstack the capacitors, dissipate the charge from the capacitor bank, transmit a disarm signal, etc.) based on the discharge error. Unstacking the capacitor bank may reduce the voltage such that the voltage of the unstacked capacitor bank is less than a threshold for activating an actuator 320 and firing the gun. In other words, unstacking the capacitor bank may prevent the gun from firing, thereby improving gun safety.

If the integrated voltage meets or exceeds the threshold voltage during the time duration, the state manager 310 may reset a flag (e.g., a Boolean value, a latch, a flip-flop, etc.) for stacking the capacitor bank and/or discharging the capacitor bank. The controller 301 may charge the capacitor bank based on the flag, thereby facilitating the automatic recharging of the capacitor bank. Automatically recharging the capacitor bank also reduces perceived latency and supports the semi-automatic firing of the gun.

Figure 4:
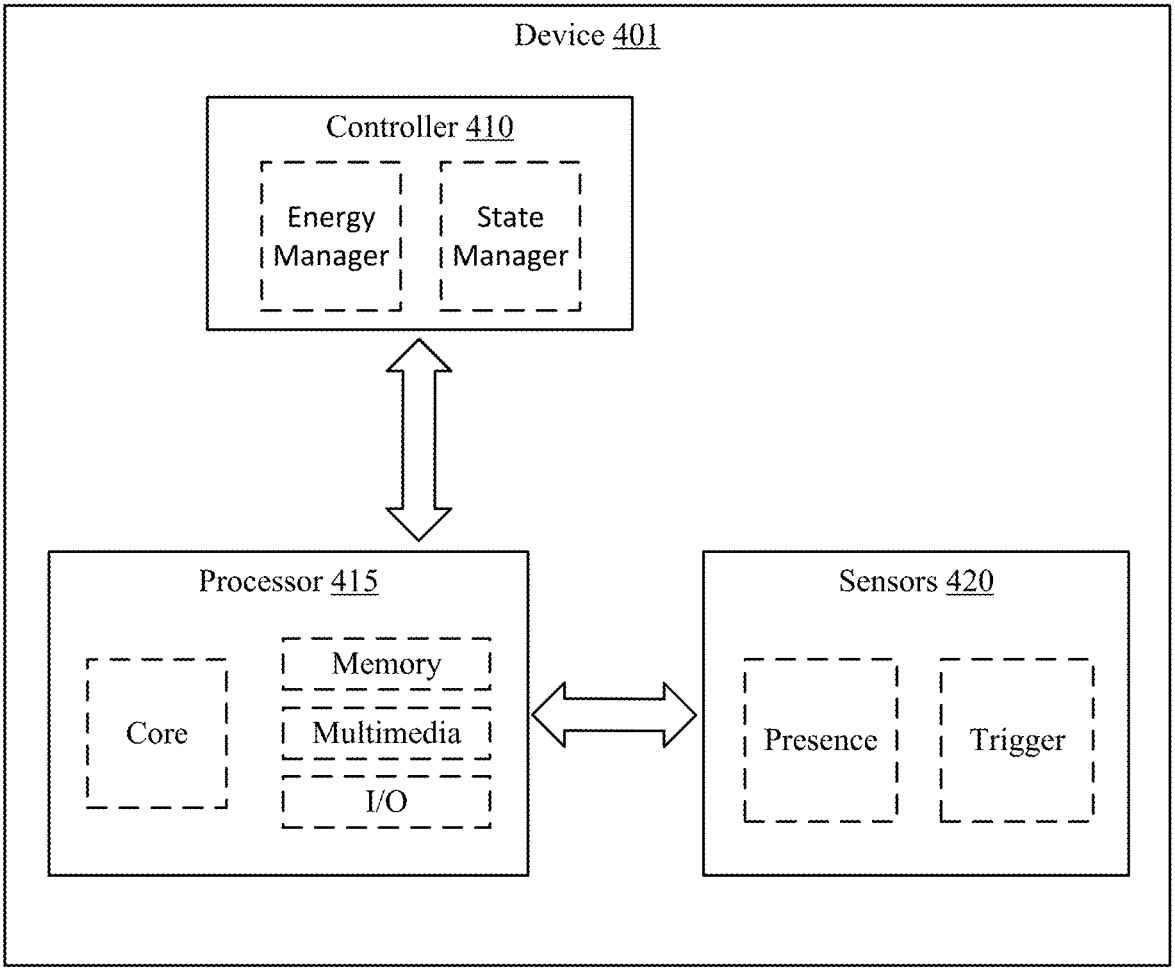
FIG. 4 illustrates an example of a device including a controller, a processor, and sensors.

FIG. 4 illustrates an example of a device 401 that implements an electronic fire control system. The device 401 may be an example or component of a gun, and the controller 410 may be an aspect of the electronic fire control system that causes the gun to fire.

The controller 410 may be electronically coupled with the processor 415, and the processor 415 may be electronically coupled with one or more sensors 420. The controller 410 may additionally or alternatively be electronically coupled with the sensor 420. The electronic couplings may include physical and/or virtual connections that support communication via communication buses, input/out (I/O) pins (e.g., general purpose I/O (GPIO) pins), point-to-point communication, networked communication, wireless interfaces, or the like.

The controller 410 may include analog electrical components that facilitate the charging of a capacitor bank and the discharging of the capacitor bank. The controller 410 may cause the capacitor bank to discharge electric current into an actuator mechanism based on a sensor 420 indicating that a trigger break has occurred. In some examples, the controller 410 may be located inside a gun chassis or a gun grip. As an illustrative example, the controller 410 may be implemented as an electrical circuit on a printed circuit board that that is located below the barrel of the gun. The controller 410 may be potted inside the chassis to increase resistance to solvents and other contaminants.

The processor 415 may be an aspect of the device 401. For example, the processor 415 may be located below the barrel of the device 401. In some examples, the processor 415 may transmit an activation signal (e.g., an arm signal) to the controller 410 to activate or otherwise arm the gun, and the controller 410 may transmit a stasis signal indicating a charge status of the capacitor bank. The statis signal may indicate that the capacitor bank is at a charged status. The controller 410 may also transmit a reset signal based on discharging electric charge from the capacitor bank, and the reset signal may indicate that the capacitor bank has discharged a threshold amount of electric charge. In some examples, the processor 415 may be passive with respect to the operations of the controller 410, which may reduce latency and improve gun reliability. As an example, the processor 415 may observe and/or receive signals generated by the controller 410, but the controller 410 may operate without input from the processor 415, thereby reducing processing latency and preventing software bugs from being introduced into the electronic fire control system of the device 401. As such, the device 401 may reduce firing system latency and improve gun reliability.

The sensors 420 may include one or more sensors, such a presence sensor, a biometric sensor, or a trigger sensor. In some examples, a first sensor may be located proximate to a grip of the device 401, and the first sensor may support the detection of user presence. For example, the first sensor may be an example of a pressure sensor, a laser proximity sensor, a mechanical switch, or a capacitive sensor that is used to determine whether a user is holding the device 401. The second sensor may be a trigger sensor (e.g., a Hall effect sensor, an optical interrupter, a pressure sensor, etc.) that is used to identify trigger movement and/or a trigger break. In some examples, the second sensor may be located proximate to a trigger of the device 401, and the second sensor may be used to identify trigger movement.

Figure 5:
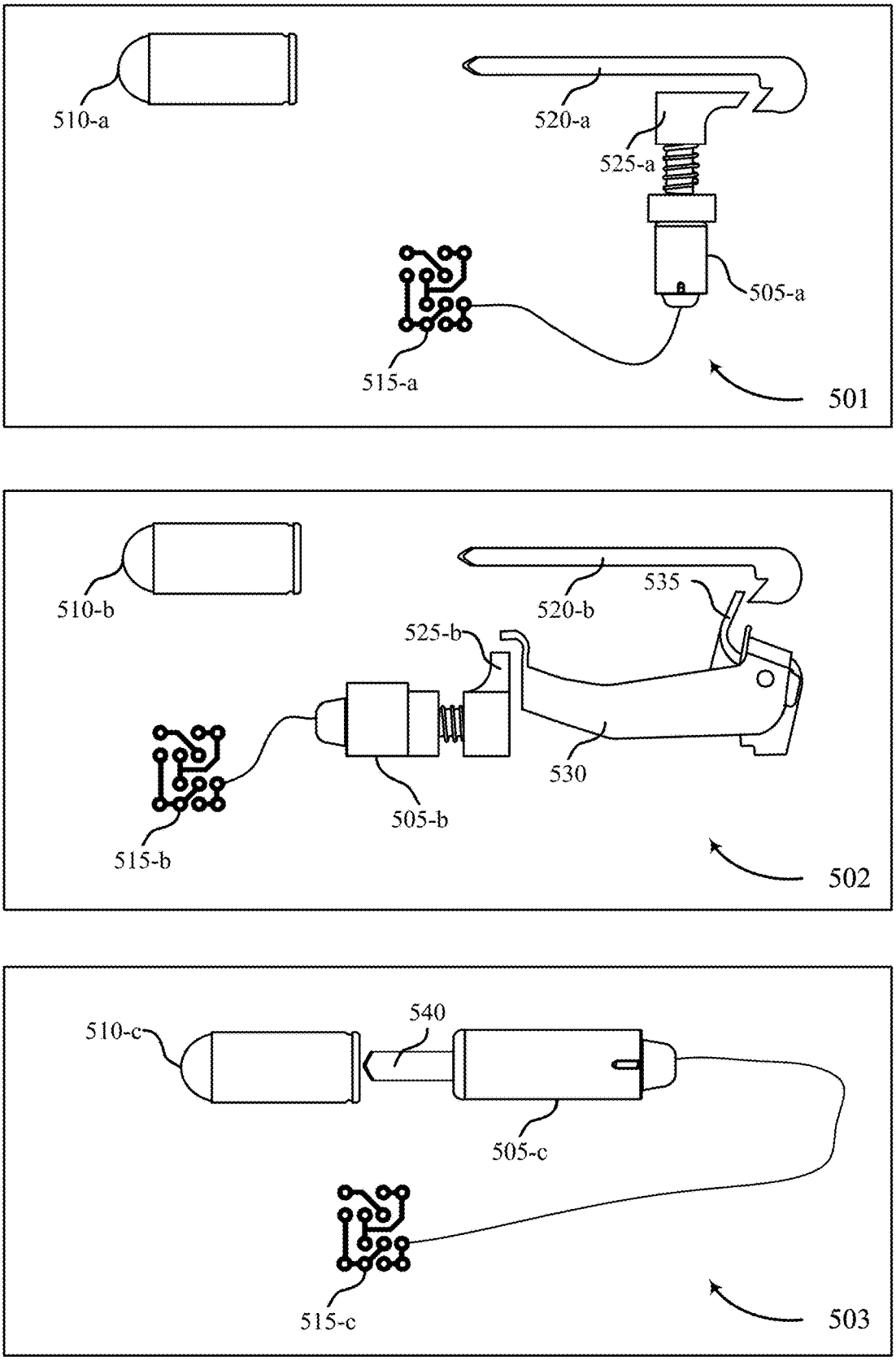
FIG. 5 illustrates examples of actuator mechanisms that may be used to fire a projectile.

FIG. 5 illustrates an example of an actuator mechanism 501, an example of an actuator mechanism 502, and an example of an actuator mechanism 503 that may be aspects of an electronic fire control system. An electronic fire control system may be integrated into a gun, and the electronic fire control system may be operable to selectively discharge projectiles from the gun.

The actuator mechanism 501 illustrates an example of an actuator 505-*a* that may be used in a gun to cause propulsion of the projectile 510-*a*. The controller 515-*a* may identify a trigger break and activate the actuator 505-*a* so as to displace the actuator block 525-*a* and release the striker 520-*a*. Releasing the striker 520-*a* may cause a firing pin to collide with a primer cap, combustion of propellant, and propulsion of the projectile 510-*a* from the gun. For example, in response to identifying the trigger break, the controller 515-*a* may transmit a signal to the actuator 505-*a* so as to cause electric charge to be directed at the actuator 505-*a*. As another example, in response to identifying the trigger break, the controller 515-*a* may transmit a signal to a capacitor bank so as to cause the capacitor bank to discharge electric charge into the actuator 505-*a*. The signal transmitted to the capacitor bank may cause rearrangement of capacitors of the capacitor bank such that a first subset of capacitors is connected in series with a second subset of capacitors, and the capacitor bank may discharge the electric charge while the first subset of capacitors is connected in series with the second subset of capacitors. The actuator 505-*a* may be an electronically activated actuator that displaces the actuator block 525-*a* in response to electric current and/or the transfer of electric charge.

The actuator mechanism 502 illustrates an example of an actuator 505-*b* that may be used in a gun to cause propulsion of the projectile 510-*b*. The controller 515-*b* may identify a trigger break and activate the actuator 505-*b* so as to displace the actuator block 525-*b*. The controller 515-*b* may activate the actuator 505-*b* by transmitting a signal to the actuator 505-*b*. In response to receiving the signal from the controller 515-*b*, the actuator 505-*b* may move the actuator block 525-*b* out of the way of the sear linkage 530, resulting in successive movement of the sear linkage 530, movement of the sear 535, and the release of the striker 520-*b*. Releasing the striker 520-*b* may cause a firing pin to collide with a primer cap, combustion of propellant, and propulsion of the projectile 510-*b* through a barrel of the gun. For example, in response to identifying the trigger break, the controller 515-*b* may transmit a signal to the actuator 505-*b* so as to cause electric charge to be directed at the actuator 505-*a*. As another example, in response to identifying the trigger break, the controller 515-*a* may transmit a signal to a capacitor bank so as to cause the capacitor bank to discharge electric charge into the actuator 505-*b*. The signal transmitted to the capacitor bank may cause rearrangement of capacitors of the capacitor bank such that a first subset of capacitors is connected in series with a second subset of capacitors, and the capacitor bank may discharge the electric charge while the first subset of capacitors is connected in series with the second subset of capacitors. The actuator

505-*b* may be an electronically activated actuator that displaces the actuator block 525-*b* in response to electric current and/or the transfer of electric charge.

The actuator mechanism 503 illustrates an example of an actuator 505-*c* that may be used in a gun to propel a projectile 510-*c* from the gun. The controller 515-*c* may identify a trigger break and transmit a signal to the actuator 505-*c*. In response to receiving the signal from the controller 515-*c*, the actuator 505-*c* may direct electric current to the conductive firing pin 540, resulting in combustion of propellant and propulsion of the projectile 510-*c* from the gun. For example, the projectile 510-*c* may be seated in a cartridge shell that includes an electronically activated primer that is ignited in response to electrifying the conductive firing pin 540. The controller 515-*c* may transmit a signal to the actuator 505-*c* to electrify the conductive firing pin 540, or the controller 515-*c* may transmit a signal to a capacitor bank so as to cause the capacitor bank to discharge electric charge into the actuator 505-*c* to electrify the conductive firing pin 540.

Figure 6:
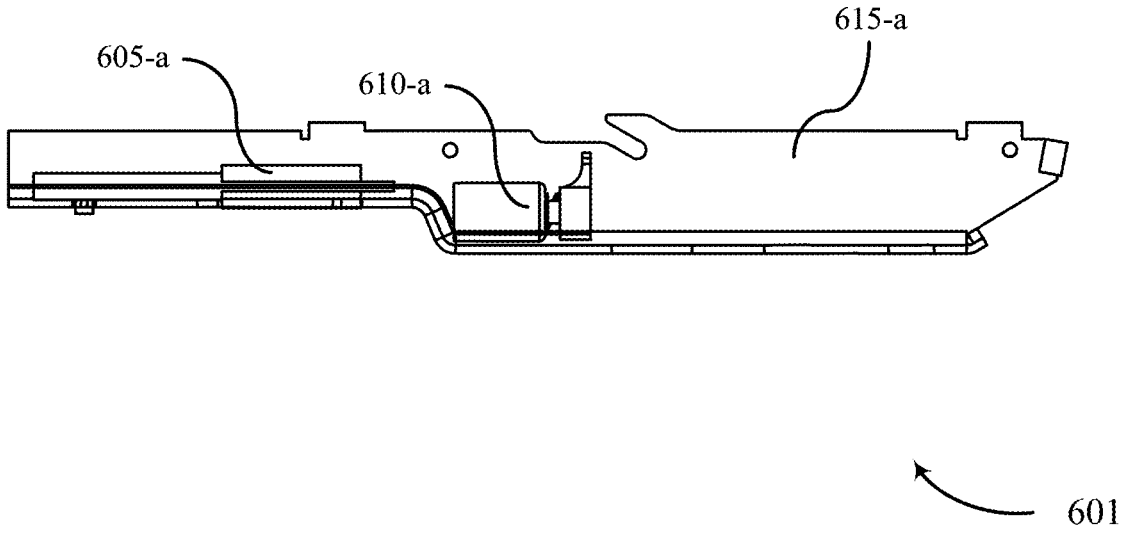
FIG. 6 illustrates examples of gun chassis including actuator mechanisms.
Figure 6:
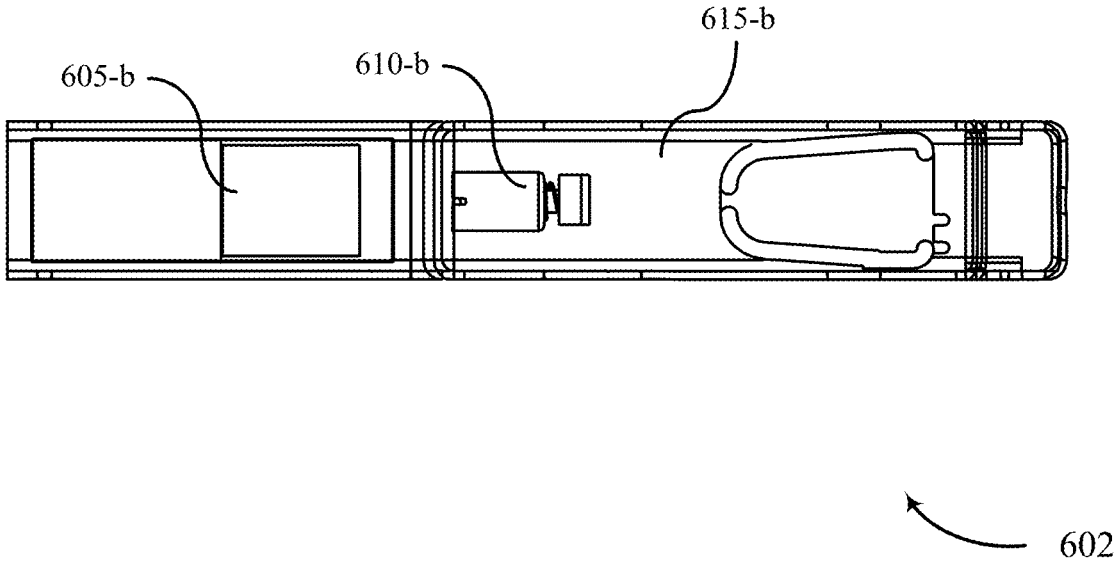

FIG. 6 illustrates a horizontal view 601 of an example of a gun chassis and a vertical view 602 of an example of a gun chassis. The horizontal view 601 of the chassis 615-*a* includes a controller 605-*a* and an actuator mechanism 610-*a*.

The controller 605-*a* may be an example a controller described herein. The actuator mechanism 610-*a* may include an electronic component (e.g., a piezo-electric element, a solenoid, etc.) that causes displacement of a mechanical component (e.g., an actuator block, a spring, a rod, etc.) in response to electric current. The actuator mechanism 610-*a* may retain a sear while in a first position (e.g., a default position) and release the sear while in a second position (e.g., an active position). The actuator mechanism 610-*a* may temporarily transition to the second position in response to electric current, and the controller 605-*a* may cause the electric current to be directed at the electronic component of the actuator mechanism 610-*a*.

The controller 605-*a* and the actuator mechanism 610-*a* may be located inside the chassis 615-*a* (e.g., a gun frame). The chassis 615-*a* may include one or more engraved markings indicating the make, the model, or the serial number of the gun.

The vertical view 602 of the gun chassis 615-*b* includes a controller 605-*b* and an actuator mechanism 610-*b*. The controller 605-*b* may be electronically coupled with the actuator mechanism 610-*b*, and the controller 605-*b* may cause displacement of the actuator mechanism 610-*b*, resulting in the gun firing a projectile.

Figure 7:
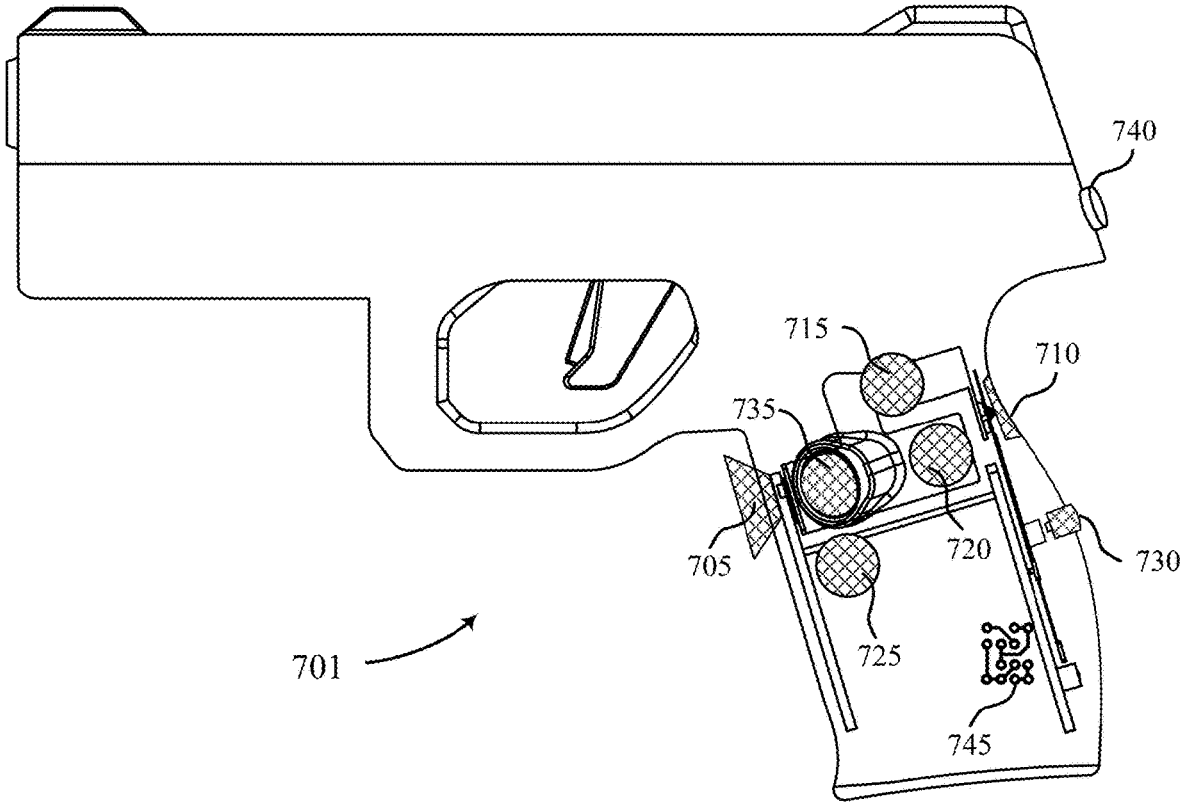
FIG. 7 illustrates an example of a gun that includes sensors that are capable of generating outputs which may be analyzed by a fire control system.

FIG. 7 illustrates an example of a gun 701 that includes sensors that are capable of generating outputs which may be analyzed by a fire control system. The gun 701 may include a controller that is electronically coupled with one or more sensors of the gun 701, and the controller may arm the gun 701 and/or cause the gun 701 to fire a projectile based on an output of a sensor of the gun 701. The controller may also disarm the gun 701 based on an output of a sensor.

The sensors of the gun 701 may be used to determine whether a user is present (e.g., whether a user is holding the gun 701, whether a user is touching the gun 701, whether a user is aiming the gun 701, etc.), and as such, the sensors of the gun 701 may be referred to as "presence sensors." The presence sensors illustrated in FIG. 7 may be used to identify user presence events and/or user absence events. The gun 701 may transition to a disarmed state (e.g., an inactive state, a state that inhibits the firing of projectiles, etc.) based on an output of a presence sensor indicating that a user is not touching the gun 701, and the gun 701 may transition to an armed state (e.g., an active state, a state that allows the firing of projectiles, etc.) based on an output of a presence sensor indicating that a user is touching the gun 701. Determining that a user is touching the gun 701 is an example of a user presence event, and determining that a user is not touching the gun 701 is an example of a user absence event.

The gun 701 includes a laser sensor 705 (e.g., a laser proximity sensor), a capacitive sensor 710 (e.g., a capacitive proximity sensor), an inductive sensor 715 (e.g., an inductive proximity sensor), an ultrasonic sensor 720 (e.g., ultrasonic proximity sensor), a pressure sensor 725 (e.g., a load cell), a mechanical switch 730 (e.g., a Hall effect sensor), a fingerprint scanner 735, a camera 740, and an accelerometer 745. The fingerprint scanner 735 and the camera 740 are examples of biometric sensors. The gun 701 may include a controller that is electronically coupled with one or more presence sensors, the controller may include a flip-flop, and the flip-flop may assert a signal based on an analysis of an of an output of a presence sensor. Asserting the signal may indicate that a user is holding the gun 701, or asserting the signal may indicate that a user is not holding the gun 701. As an illustrative example, the controller may assert a low voltage signal to indicate that a user is not holding the gun 701 proximate to a presence sensor, and the controller may assert a high voltage signal to indicate that a user is holding the gun 701 proximate to a presence sensor.

In some examples, the analysis of the output of the presence sensor may be performed by an aspect of the controller, such as a signal processing circuit. Asserting the signal may cause the gun 701 to enter an armed state. For example, the controller may determine that the output matches a predetermined value, or the controller may determine that the output satisfies a threshold, and the controller may assert the signal based on the output matching the predetermined value or satisfying the threshold. In some examples, the gun 701 may assume an armed state in response to the controller asserting the signal, while in some other examples, the gun 701 may assume a disarmed state in response to the controller asserting the signal. The controller may identify a trigger break and cause the gun 701 to fire based on the trigger break and the gun 701 being in the armed state. Using presence sensors to determine whether a user is holding the gun 701 inhibits accidently firing the gun 701 when a user is not holding the gun 701, thereby improving the safety of the gun 701.

Figure 8:
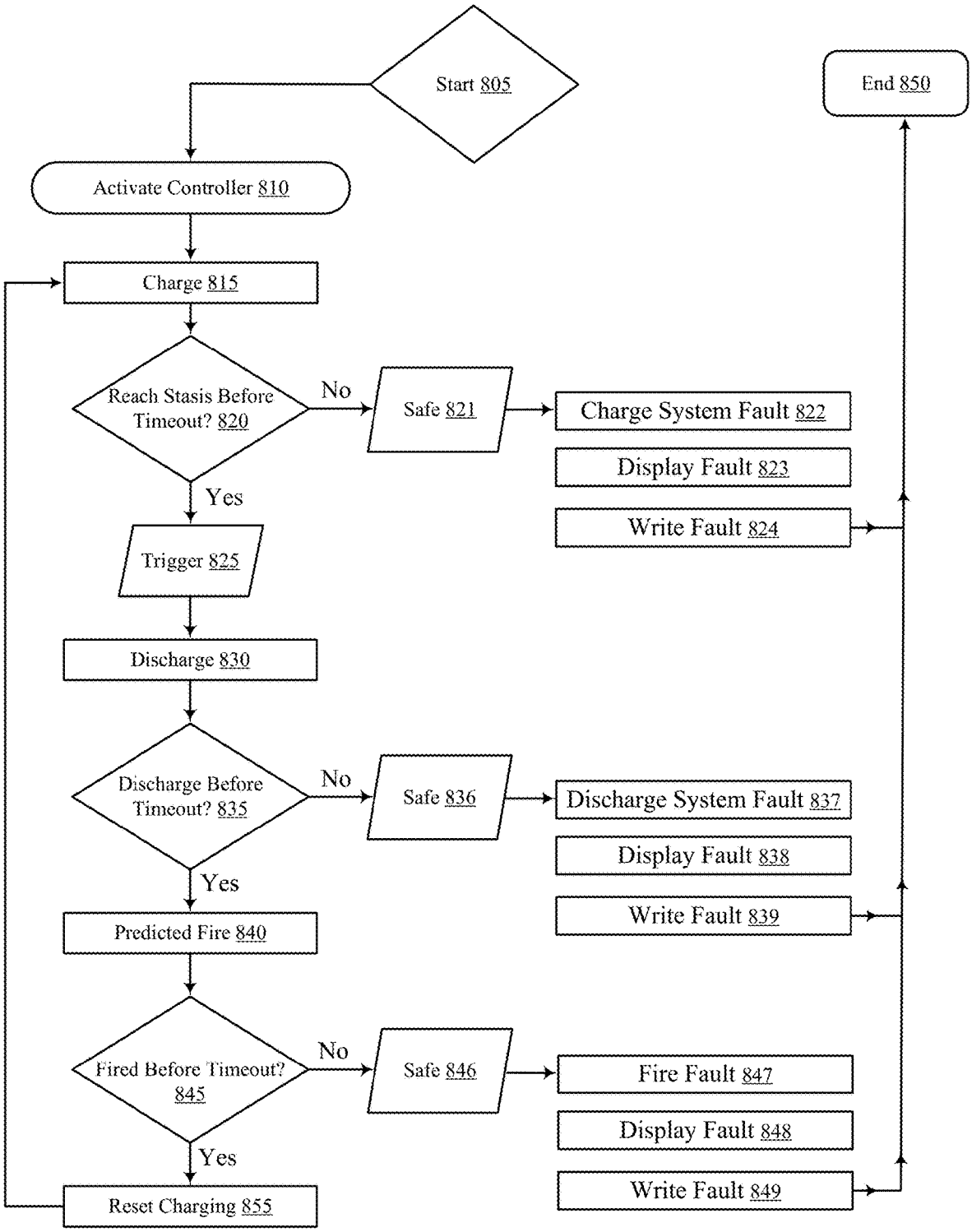
FIG. 8 illustrates an example of a process flow for operating an electronic fire control system.

FIG. 8 illustrates an example of a process flow 800 of operating a fire control system. Aspects of the process flow 800 may be performed by a gun, a processor, a controller, or an electronic component of a gun. Alternative examples of the following may be implemented where some steps are performed in a different order than described or are not performed at all. The steps may include additional features not mentioned below, and further steps may be added.

The process flow 800 starts at step 805. In some examples, the process flow 800 may start at step 805 based on a user being present and/or the user being authenticated. For example, one or more presence sensors (e.g., a pressure sensor, a mechanical switch, a capacitive sensor, etc.) may transmit an interrupt signal to a processor and/or a controller to indicate that a user is present, and the processor may authenticate the identity of the user by verifying biometric data (e.g., facial recognition, fingerprint recognition, palm print recognition, etc.) of the user.

At step 810, the processor may activate the controller. In some examples, the processor may activate the controller by transmitting an arm signal (e.g., activation signal) to the controller in response to authenticating the identity of the user. Activating the controller may include providing power to the controller, signaling an I/O pin, or transmitting a signal to a flip-flop (e.g., a level-triggered flip-flop an edge-triggered flip-flop, a latch, etc.). As an example, the processor may transmit an arm (e.g., activate) signal to the controller based on the user being present and the identity of the user being authenticated.

At step 815, the controller may charge a capacitor bank with electric charge, and the capacitor bank may include one or more capacitors. The controller may charge the capacitor bank such that a voltage condition is satisfied. In some examples, the controller may charge the capacitor bank based on activating the controller. For example, activating the controller may include transmitting a signal to a flip-flop of the controller, and transmitting the signal to the flip-flop may cause electric current to be directed from an energy store (e.g., a battery pack, a battery cell, etc.) to the capacitor bank. Charging the capacitor bank may be inhibited when the signal is not transmitted to the flip-flop, thereby mitigating the possibility of unintentionally charging the capacitor bank.

If the gun does not reach stasis before timeout at step 820, the controller may assert safe at step 821. The time duration for the timeout may be configured based on a capacitor bank size, the voltage threshold of the capacitor bank, a number of capacitors included in the capacitor bank, a capacitance value of a capacitor of the capacitor bank, a charging voltage, or a combination thereof. The gun may reach stasis when the voltage condition is satisfied, and the voltage condition may be satisfied when a stored voltage of the capacitor bank exceeds a reference voltage.

Asserting safe at step 821 may include transitioning to a disarmed state, clearing one or more flip-flops, unstacking the capacitor bank (e.g., connecting the capacitors of the capacitors bank in parallel), engaging a safety mechanism, or a combination thereof. Asserting safe may inhibit the gun from firing projectiles.

At step 822, the controller may identify a charge system fault. The controller may identify the charge system fault based on the timeout occurring prior to the capacitor bank reaching stasis. At step 823, the gun may display the fault to a user. In some examples, the gun may display fault information at a display panel or user interface. In some additional or alternative examples, the gun may display fault information by generating a color at an LED, generating a light pulse pattern, generating a haptic pulse, generating an audible tone, or a combination thereof. At step 824, the gun may write fault information to memory (e.g., generate a log file).

If the gun does reach stasis before timeout at step 820, the controller may monitor a trigger sensor for a trigger beak. At step 825, the controller may identify a trigger break. For example, the controller may identify the trigger break at step 825 using one or more trigger sensors generating outputs indicating that a trigger break has occurred. For example, the controller may identify the trigger break based on an output of a trigger sensor exceeding a threshold, such as a voltage threshold, a current threshold, or a time threshold.

At step 830, the capacitor bank may discharge electric current. The capacitor bank may discharge the electric current based on the trigger break. For example, the capacitor bank may discharge electric charge by directing electric current through an actuator solenoid and directing the electric current through the actuator solenoid may cause successive displacement of the actuator and a sear, and the successive displacement of the actuator and the sear may result in the gun firing a projectile.

If the gun (or the capacitor bank) does not discharge a threshold amount of electric charge before timeout at step 835, the gun may assert safe at step 836. The time duration for the timeout may be configured based on a capacitor bank size, the voltage threshold of the capacitor bank, a number of capacitors, or a combination thereof.

Asserting safe at step 836 may include transitioning to a disarmed state, clearing one or more flip-flops, unstacking the capacitor bank (connecting the capacitors of the capacitors bank in parallel), engaging a safety mechanism, or a combination thereof.

At step 837, the controller may identify a discharge system fault. The controller may identify the discharge system failure based on the timeout occurring prior to the capacitor bank discharging the threshold amount of electric charge. At step 838, the gun may display the fault to a user. In some examples, the gun may display fault information at a display panel or user interface. In some additional or alternative cases, the gun may display fault information by generating a color at an LED, generating a light pulse pattern, generating a haptic pulse, generating an audible tone, or a combination thereof. At step 839, the gun may write fault information to memory (e.g., generate a log file).

If, at step 835, the gun does discharge the threshold amount of electric charge before the timeout, the controller may predict that the gun has fired at step 840. The controller may write a data value to memory (e.g., generate a log file) indicating that it is predicted that the gun has fired. In some examples, the gun may write data to memory or generate a log file based on a user opting-in to the collection of log data. The log data may be stored in memory of the gun and the gun may refrain from transmitting the data to a device that is external to the gun. The log data may be encrypted prior to storage and the encrypted data may be stored in the memory of the gun.

At step 845, the controller may determine whether the gun has fired. Determining whether the gun has fired may be based on one or more inertial measurement unit (IMU) measurements, accelerometer measurements, or gyroscope measurements taken during a period of time following (i) the trigger break or (ii) the capacitor bank discharging electric charge.

If it is determined that the gun has not fired before the timeout at step 845, the controller may assert safe at step 846. The time duration for the timeout may be configured based on an ammunition type, a cartridge caliber, a gun type, a gun configuration, or the like.

Asserting safe at step 846 may include transitioning to a disarmed state, clearing one or more flip-flops, unstacking the capacitor bank (connecting the capacitors of the capacitors bank in parallel), engaging a safety mechanism, or a combination thereof.

At step 847, the controller may identify a fire fault. The controller may identify the fire fault based on the timeout occurring prior to determining that the gun has fired. At step 848, the gun may display the fault to a user. In some cases, the gun may display fault information at a display panel or user interface. In some additional or alternative cases, the gun may display fault information by generating a color at an LED, generating a light pulse pattern, generating a haptic pulse, generating an audible tone, or a combination thereof. At step 849, the gun may write fault information to memory (e.g., generate a log file).

At step 850, the process flow may end. The gun may terminate a firing procedure at step 850 based on identifying a fault or error, asserting safe, or a timeout occurring.

At step 855, the controller may reset the charging of the capacitor bank. For example, based on determining that the gun has fired before timeout at step 845, the gun may reset charging at step 855. As part of resetting the charging of the capacitor bank, the controller may alter the state of the gun, clear one or more flip-flops, or modify one or more variables (e.g., toggle flags, activate I/O pins, etc.). The controller may charge the capacitor bank at step 815 based on resetting the charging of the capacitor bank at step 855.

Figure 9:
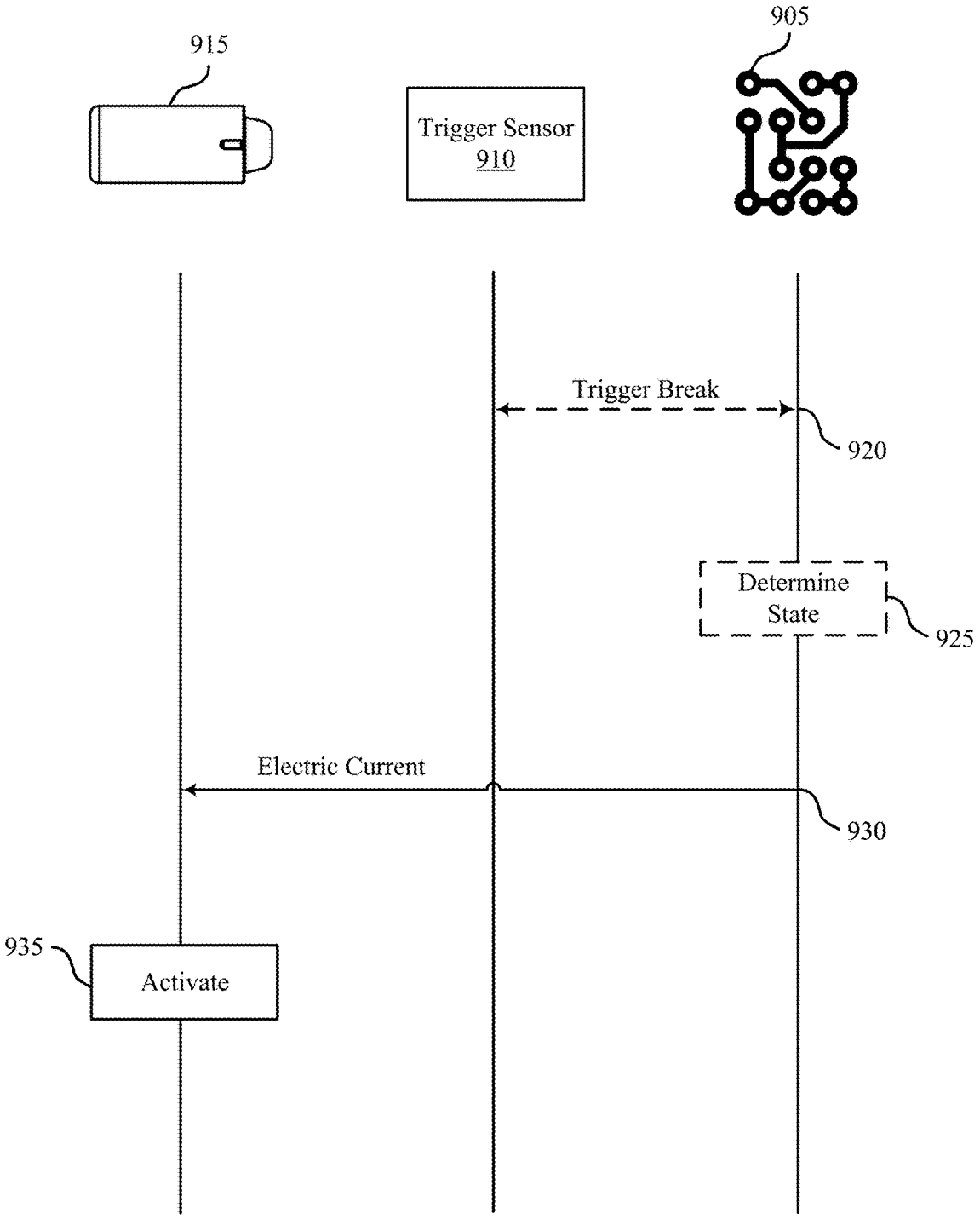
FIG. 9 illustrates an example of a process flow for operating an electronic fire control system.

FIG. 9 illustrates an example of a process flow 900 of operating a fire control system. The fire control system may be an aspect of a gun, and the fire control system may include a controller 905, a trigger sensor 910, and an actuator mechanism 915. Alternative examples of the following may be implemented, where some steps are performed in a different order than described or are not performed at all. In some cases, steps may include additional features not mentioned below, or further steps may be added.

At step 920, the controller 905 may identify a trigger break based on an output of the trigger sensor 910 (e.g., a Hall effect sensor, a load cell, a photointerrupter sensor, etc.). The output of the trigger sensor 910 may be an example of a digital signal or an analog signal. As an example, the output of the trigger sensor 910 may be an analog signal and the voltage of the analog signal may represent an amount of pressure being applied onto the trigger sensor, a direction of magnetic flux, a magnitude of magnetic flux, an amount of light being received at the trigger sensor, or the like, and the controller 905 may identify the trigger break based on the voltage exceeding a threshold voltage. As another example, the trigger sensor 910 may determine that a trigger threshold (e.g., a trigger displacement threshold or a trigger force threshold) is satisfied and generate a digital interrupt signal indicating that the trigger threshold is satisfied, and the controller 905 may identify the trigger break based on the trigger sensor 910 generating the digital interrupt signal.

At step 925, the controller 905 may determine the state of the gun. As an example, the controller 905 may determine that the gun is in an armed state and cause electric current to be directed at the actuator mechanism 915 in response to determining that the gun is in the armed state. The controller 905 may determine that the gun is in the armed state based on a user authentication procedure verifying the identity of the user, based on a presence sensor indicating that the user is presently holding the gun, based on a flip-flop asserting a signal indicating that the user is both authorized and presently holding the gun, or any combination thereof. As another example, the controller 905 may determine that the gun is in a disarmed state and inhibit electric current from being directed at the actuator mechanism 915 in response to determining that the gun is in the disarmed state.

At step 930, the controller 905 may cause electric current to be directed at the actuator mechanism 915, and the controller 905 may cause the electric current to be directed at the actuator mechanism 915 based on determining that the gun is in an armed state at step 925. As an example, the controller 905 may cause electric current to be directed at the actuator mechanism 915 by transmitting a signal to a capacitor bank so as to cause the capacitor bank to discharge electric charge. In some examples, the signal may be encoded (e.g., encrypted, spread, etc.) and the capacitor bank may discharge electric charge based on decoding (e.g., decrypting, dispreading, etc.) the signal. As an illustrative example, a first component (e.g., a first field programmable gate array (FPGA), a first digital signal processor (DSP), a first application specific integrated circuit (ASIC), etc.) of the controller may encode the signal using a signal spreading code, a second component (e.g., a second FPGA, a second DSP, a second ASIC, etc.) of the controller may decode the signal using the signal spreading code, and the capacitor bank may discharge electric charge based on decoding the encoded signal. The capacitor bank may be electronically coupled with the actuator mechanism 915 and discharging the capacitor bank may including directing electric current through a solenoid or a piezoelectric element of the actuator mechanism.

At step 935, the actuator mechanism 915 may be activated in response to the electric current. Activating the actuator mechanism 915 may including displacing a mechanical component of the actuator mechanism 915, electrifying a conductive firing pin of the actuator mechanism, generating an electromagnetic field, or performing another action that results in a projectile being accelerated through a barrel of the gun.

Figure 10:
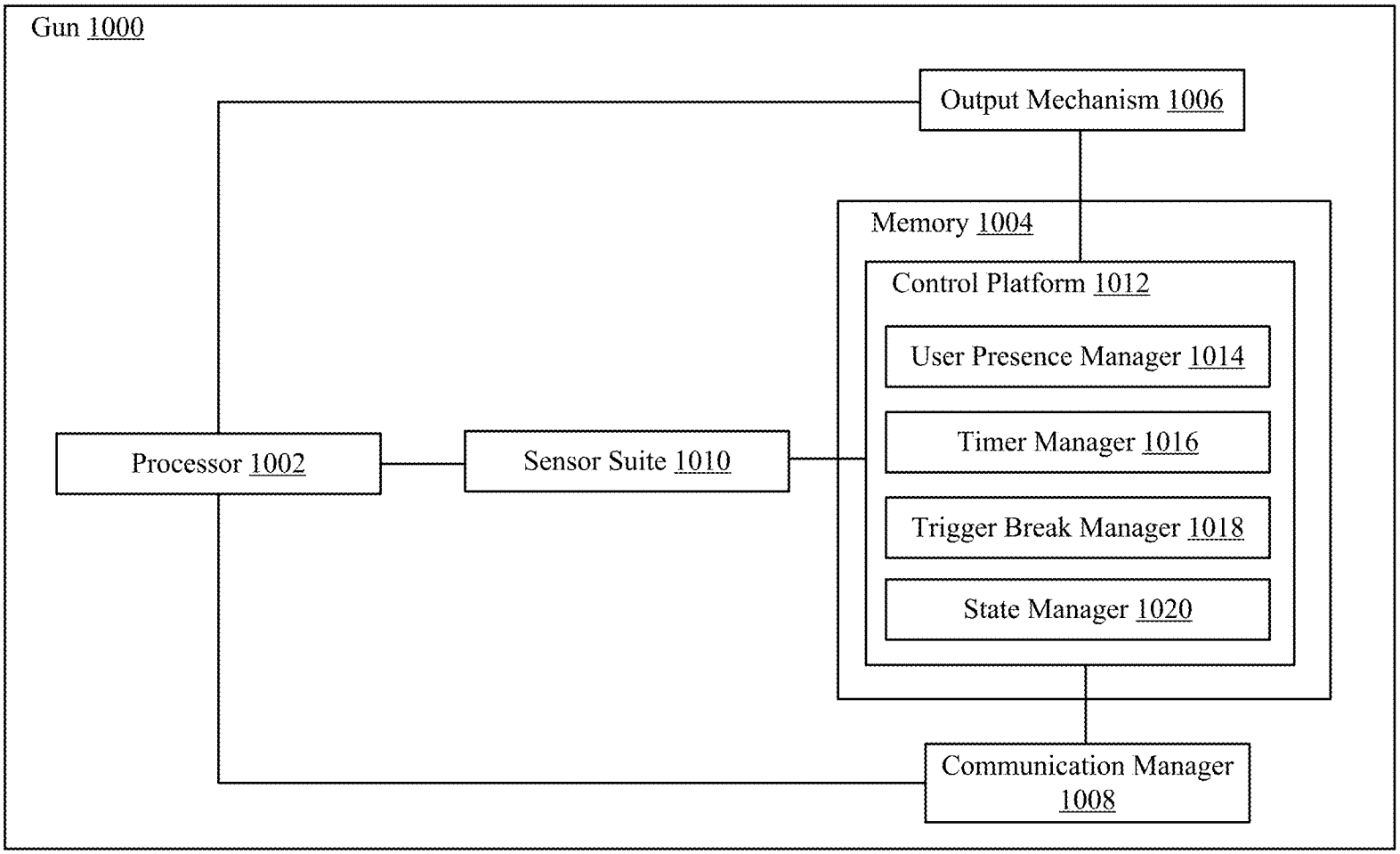
FIG. 10 illustrates an example of a gun that includes a fire control system.

FIG. 10 illustrates an example of a gun 1000 able to implement a control platform 1012 designed to produce outputs that are helpful in operating the gun 1000. As further discussed below, the control platform 1012 (also referred to as a "management platform" or a "controller") may be designed to manage an electronic fire control system.

In some embodiments, the control platform 1012 is embodied as an electrical circuit that performs operations and enforces logic state for the gun 1000. In other embodiments, the control platform 1012 is embodied as a computer program that is executed by the gun 1000. In yet other embodiments, the control platform 1012 is embodied as a computer program that is executed by a computing device to which the gun 1000 is communicatively connected. In such embodiments, the gun 1000 may transmit relevant information to the computing device for processing as further discussed below. Those skilled in the art will recognize that aspects of the computer program could also be distributed amongst the gun 1000 and computing device.

The gun 1000 can include a processor 1002, memory 1004, an output mechanism 1006, and a communication manager 1008. The processor 1002 can have generic characteristics similar to general-purpose processors, or the processor 1002 may be an ASIC that provides control functions to the gun 1000. As shown in FIG. 10, the processor 1002 can be coupled with all components of the gun 1000, either directly or indirectly, for communication purposes.

The memory 1004 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 1002, the memory 1004 can also store data generated by the processor 1002 (e.g., when executing the managers of the control platform 1012). Note that the memory 1004 is merely an abstract representation of a storage environment. The memory 1004 could be comprised of actual memory chips or managers.

The output mechanism 1006 can be any component that is capable of conveying information to a user of the gun 1000. For example, the output mechanism 1006 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 1000. Thus, the display may indicate whether the gun 1000 is presently in an armed state (e.g., an unlocked state, an active state, etc.) or a disarmed state (e.g., a locked state, an inactive state, etc.). The display may additionally or alternatively indicate error or fault information to the user. As another example, the output mechanism 1006 may be a loudspeaker (or simply "speaker") that is able to audibly convey information to the user.

The communication manager 1008 may be responsible for managing communications between the components of the gun 1000. Additionally or alternatively, the communication manager 1008 may be responsible for managing communications with computing devices that are external to the gun 1000. Examples of computing devices include mobile phones, tablet computers, wearable electronic devices (e.g., fitness trackers), and network-accessible server systems comprised of computer servers. Accordingly, the communication manager 1008 may be wireless communication circuitry that is able to establish communication channels with computing devices. Examples of wireless communication circuitry include integrated circuits (also referred to as "chips") configured for Bluetooth, Wi-Fi®, NFC, and the like.

Sensors are normally implemented in the gun 1000. Collectively, these sensors may be referred to as the "sensor suite" 1010 of the gun 1000. For example, the gun 1000 may include a motion sensor whose output is indicative of motion of the gun 1000 as a whole. Examples of motion sensors include multi-axis accelerometers and gyroscopes. As another example, the gun 1000 may include a proximity sensor whose output is indicative of proximity of the gun 1000 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. A proximity sensor may be an example of a presence sensor. As another example, the gun 1000 may include a fingerprint scanner or camera that generates images which can be used for, for example, biometric authentication. As shown in FIG. 10, outputs produced by the sensor suite 1010 may be provided to the control platform 1012 for examination or analysis.

For convenience, the control platform 1012 may be referred to as a computer program that resides in the memory 1004. However, the control platform 1012 could be comprised of software, firmware, or hardware components that are implemented in, or accessible to, the gun 1000. In accordance with embodiments described herein, the control platform 1012 may include a user presence manager 1014, a timer manager 1016, a trigger break manager 1018, and a state manager 1020. As an illustrative example, the user presence manager 1014 may process data generated by, and obtained from, a presence sensor, the timer manager 1016 may process data generated by, and obtained from, a clock (e.g., a real-time clock), the trigger break manager 1018 may process data generated by, and obtained from, a trigger sensor, and the state manager 1020 may implement a state machine. The state machine may be implemented with analog and/or digital electronic components, and the state machine may modify a current state of the gun 1000 based on outputs generated by sensors of the sensor suite 1010. Because the data obtained by these managers may have different formats, structures, and content, the instructions executed by these managers can (and often will) be different. For example, the instructions executed by the user presence manager 1014 to process data generated by a presence sensor may be different than the instructions generated by the trigger break manager 1018 to identify a trigger break. As a specific example, the user presence manager 1014 may implement signal filtering algorithms (e.g., for denoising, smoothing, etc.) that are not necessary for processing data generated by a trigger sensor (e.g., a load cell).

Figure 11:
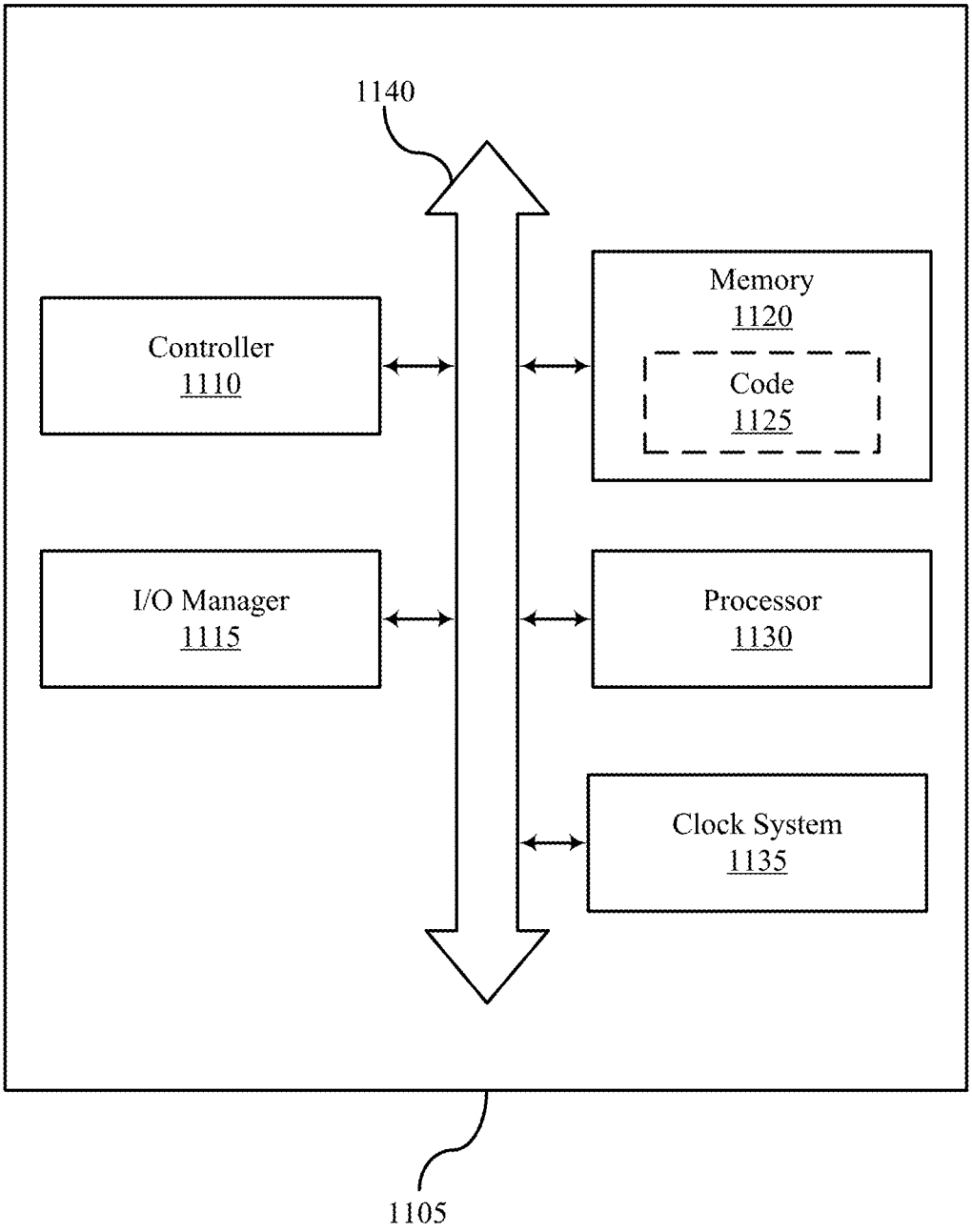
FIG. 11 illustrates an example of a system that includes a fire control system.

FIG. 11 illustrates an example of a system 1100 that supports managing a fire control system. The device 1105 may be operable to implement the techniques, technology, or systems disclosed herein. The device 1105 may include components such as a controller 1110, an I/O manager 1115, memory 1120, code 1125, a processor 1130, a clock system 1135, and a bus 1140. The components of the device 1105 may communicate via one or more buses 1140. The device 1105 may be an example of, or include components of, a gun or a fire control system.

The controller 1110 may cause a capacitor bank to be charged with electric charge until a stored voltage satisfies a voltage threshold, where the capacitor bank includes a plurality of capacitors that are connected in parallel, transmit a first signal indicating a charge status of the capacitor bank to an electronic flip-flop in response to a determination that the stored voltage satisfies the voltage threshold, identify a trigger break through real time analysis of an output generated by a trigger sensor of the fire control system, where the identifying the trigger break is in response to the output indicating that trigger movement exceeds a displacement threshold, transmit a second signal to the electronic flip-flop in response to the identifying the trigger break, and transmit a third signal based on the first signal and the second signal, where the third signal causes: (i) modification of the capacitor bank such that a first subset of the plurality of capacitors is connected in series with a second subset of the plurality of capacitors and (ii) discharge of the electric charge from the capacitor bank, where the electric charge is directed through a solenoid of an actuator mechanism to cause successive displacement of the actuator mechanism, a sear, and a firing pin that strikes a cartridge primer cap so as to produce combustion, and where the combustion results in propulsion of a projectile through a barrel.

The controller 1110 may cause capacitor bank to be charged with electric charge, where the capacitor bank includes a plurality of capacitors, identify a trigger break through an analysis of an output generated by a trigger sensor of the fire control system, and transmit a signal in response to the identifying the trigger break, where the signal causes: discharge of the electric charge from the capacitor bank such that electric charge is directed at an actuator mechanism to cause displacement of the actuator mechanism, where the displacement of the actuator mechanism results in propulsion of a projectile through a barrel.

The I/O manager 1115 may manage input and output signals for the device 1105. The I/O manager 1115 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1120 may include or store code (e.g., software) 1125. The memory 1120 may include volatile memory, such as random-access memory (RAM) and/or non-volatile memory, such as read-only memory (ROM). The code 1125 may be computer-readable and computer-executable, and when executed, the code 1125 may cause the processor 1130 to perform various operations or functions described here.

The processor 1130 may be an example or component of a central processing unit (CPU), an ASIC, or an FPGA. In some embodiments, the processor 1130 may utilize an operating system or software such as Microsoft Windows®, iOS®, Android®, Linux®, Unix®, or the like. The clock system 1135 control a timer for use by the disclosed embodiments.

The controller 1110, or its sub-components, may be implemented in hardware, software (e.g., software or firmware) executed by a processor, or a combination thereof. The controller 1110, or its sub-components, may be physically located in various positions. For example, in some cases, the controller 1110, or its sub-components may be distributed such that portions of functions are implemented at different physical locations by one or more physical components.

Figure 12:
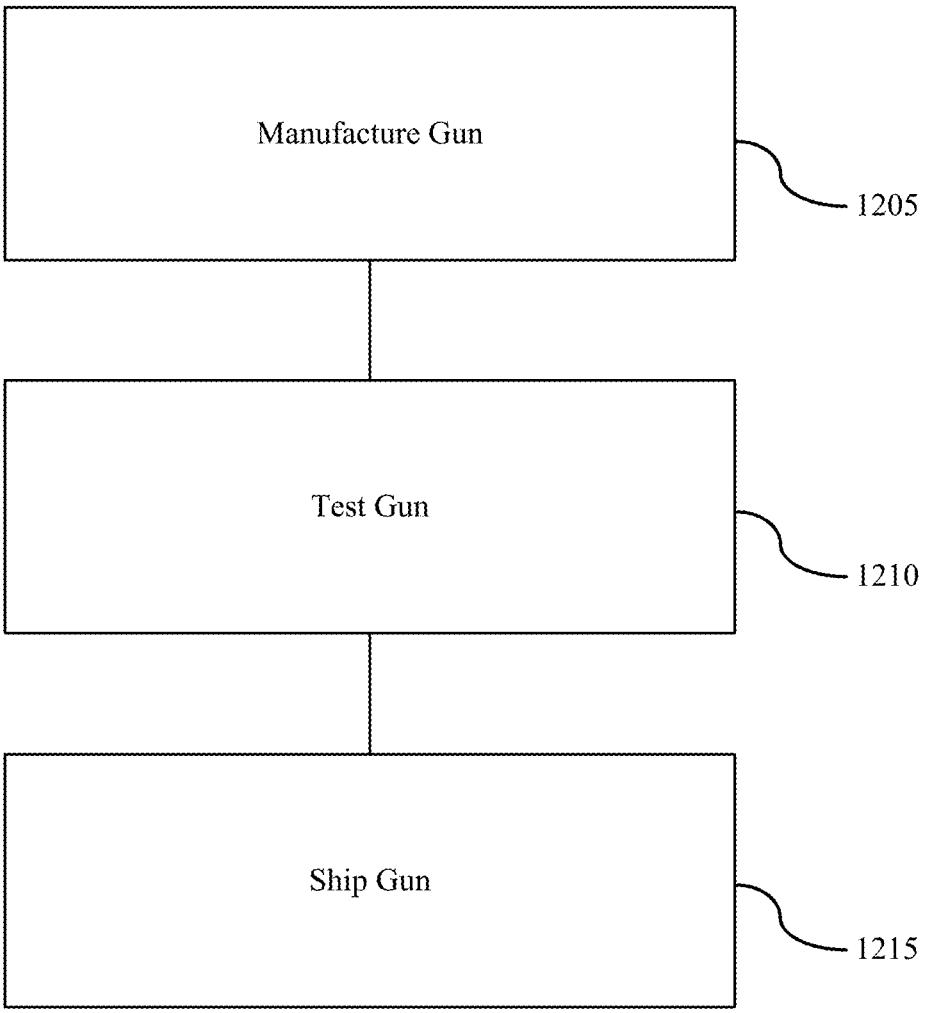
FIG. 12 illustrates an example of flowchart showing a method of manufacturing a gun that includes a fire control system.

FIG. 12 illustrates an example of a flowchart 1200 showing a method of manufacturing a gun that includes an electronic fire control system. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a gun that is able to implement aspects of the present disclosure (step 1205). For example, the manufacturer may machine, cut, shape, or otherwise make parts to be included in the gun. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. Often, the manufacturer will obtain some parts and make other parts that are assembled together to form the gun (or a component of the gun).

The manufacturer or another entity may generate, store, deploy, or otherwise manage cryptographic data associated with a device. For example, the manufacturer may deploy a cryptographic secret (e.g., a cryptographic key used for deriving a cryptographic key) into memory of the device to support encryption and decryption at the device, the manufacturer may deploy a public cryptographic key into the memory of the device to support verifying cryptographic signatures, the manufacturer may deploy a private cryptographic key into the memory of the device to support generating cryptographic signatures, or the manufacturer may deploy a digital certificate into the memory of the device to cryptographically identify the manufacture or an associated entity.

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1210). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., one test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, or the manufacturer could test the gun as a whole. For example, the manufacturer may test the barrel to verify that it meets a precision threshold and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

The manufacturer may develop and/or test an electronic fire control system. The electronic fire control may be tested as a standalone system, as a system integrated into a gun, or both. The fire control system may include a controller, an actuator mechanism, and a capacitor bank. The manufacturer may test the actuator mechanism in isolation and the fire control system as a whole. The manufacturer may also develop instructions that support performing functions at an electronic component of a gun, such as an ambient light sensor, a presence sensor, a biometric sensor, a controller, or a processor. For example, the manufacturer may produce software and/or firmware that supports measuring ambient light and modifying the brightness of an electronic aiming sight of the gun based on the amount of ambient light measured. As another example, the manufacturer may produce an electrical circuit that determines whether to fire the gun and transmits an electrical signal to an actuator mechanism to cause the gun to fire a projectile.

Thereafter, the manufacturer may ship the gun to a dealer (step 1215). In the event that the gun is a firearm, the manufacturer may ship the gun to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the gun, and therefore perform multiple iterations of steps 1205 and 1210 either sequentially or simultaneously (e.g., one component may be tested while another component is added to the gun). Thus, the descriptions of these processes are intended to be open ended.

Figure 13:
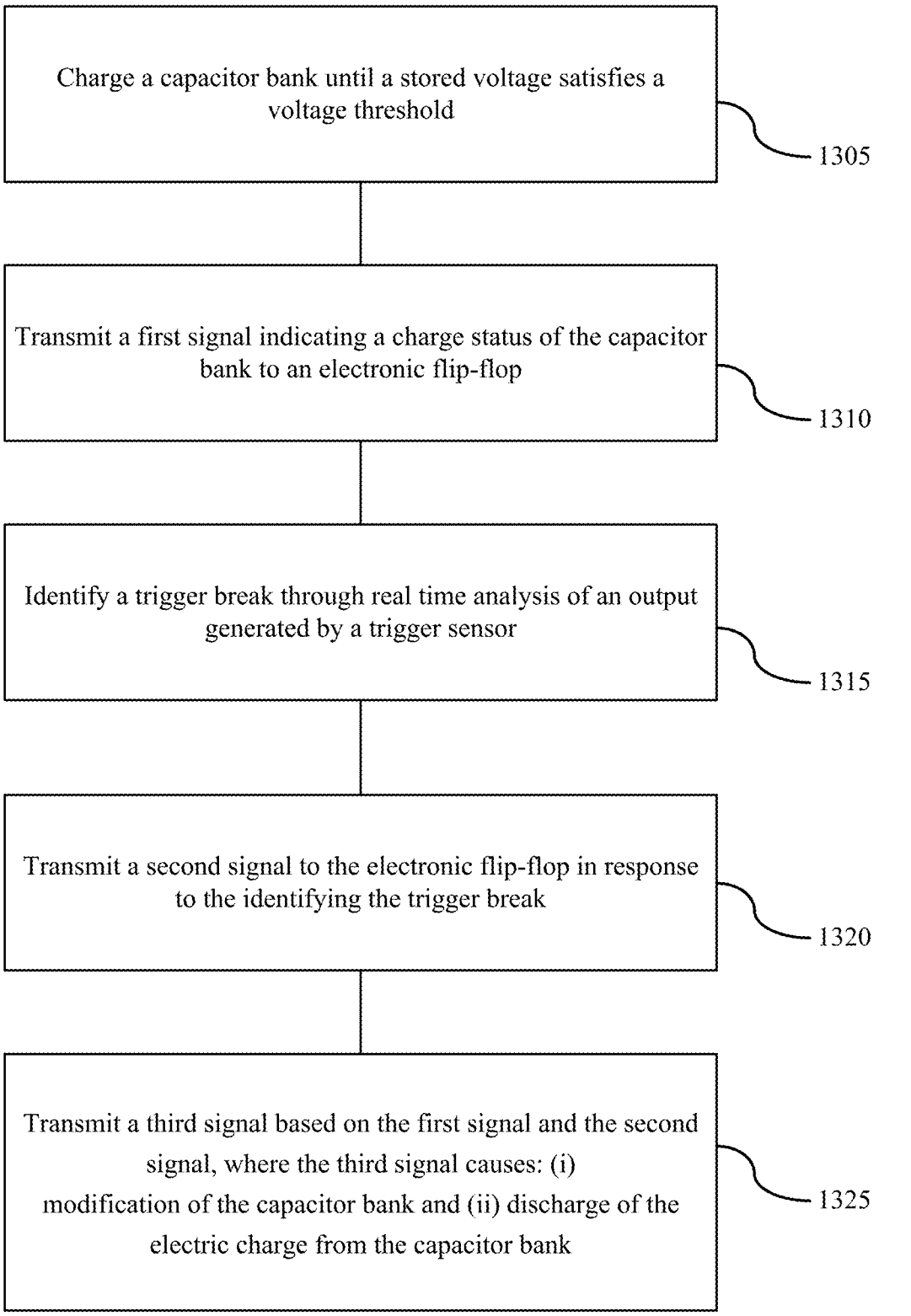
FIG. 13 illustrates an example of a flowchart showing a method of operating a fire control system.

FIG. 13 shows a flowchart illustrating a method 1300 of operating a fire control system. The operations of the method 1300 may be implemented by a gun or its components as described herein. For example, the operations of the method 1300 may be performed by a fire control system or a controller as described herein. In some examples, a gun may execute a set of instructions to control the functional elements of the to perform the described functions. Additionally or alternatively, the gun may perform aspects of the described functions using special-purpose hardware.

At step 1305, the gun may charge a capacitor bank until a stored voltage satisfies a voltage threshold. The stored voltage may indicate a voltage of the capacitor bank. In some examples, the stored voltage may indicate the voltage of the capacitor bank while the capacitors of the capacitor bank are connected in parallel.

At step 1310, the gun may transmit a first signal indicating a charge status of the capacitor bank to an electronic flip-flop. As an example, the gun may transmit a statis signal to indicate that the capacitor bank has reached stasis, and the capacitor bank may transition from a rapid charging state to a trickle charging state. In other words, a high current may be used to charge the capacitor bank until the stasis signal is asserted and a low current may be used to maintain the charge once the stasis signal is asserted.

At step 1315, the gun may identify a trigger break through real time analysis of an output generated by a trigger sensor. As an example, the gun may determine that a voltage of an analog signal satisfies a voltage threshold, and the gun may identify the trigger break based on the analog signal satisfying the voltage threshold. As another example, the gun may determine that a digital signal matches a predetermined value, and the gun may identify the trigger break based on the digital signal matching the predetermined value.

At step 1320, the gun may transmit a second signal to the electronic flip-flop in response to the identifying the trigger break. In some examples, the second signal may be transmitted to a logic gate (e.g., an AND gate, an OR gate, etc.).

At step 1325, the gun may transmit a third signal based on the first signal and the second signal, where the third signal causes: (i) modification of the capacitor bank and (ii) discharge of the electric charge from the capacitor bank. As an example, the third signal may be an output of the logic gate, and the third signal may be generated based on the assertion of both the first signal and the second signal.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 14:
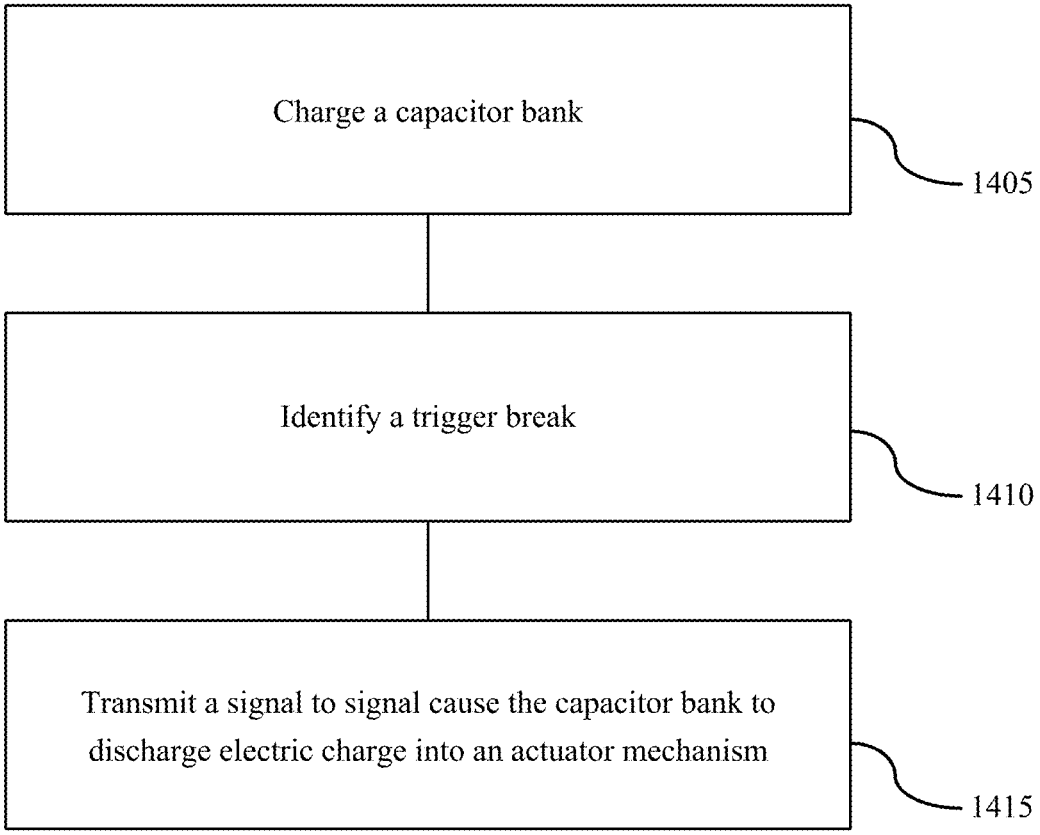
FIG. 14 illustrates an example of a flowchart showing a method of operating a fire control system.

FIG. 14 shows a flowchart illustrating a method 1400 of operating a fire control system. The operations of the method 1400 may be implemented by a gun or its components as described herein. For example, the operations of the method 1400 may be performed by a fire control system or a controller as described herein. In some examples, a gun may execute a set of instructions to control the functional elements of the to perform the described functions. Additionally or alternatively, the gun may perform aspects of the described functions using special-purpose hardware.

At step 1405, the gun may charge a capacitor bank. A controller may cause the capacitor bank to be charged with electric charge based on a user authentication procedure, based on a user presence procedure, or both. For example, the controller may perform a user authentication procedure to verify the identity of the user holding the gun, and the controller may cause the capacitor bank to be charged based on verifying the identify of the user. As another example, the controller may perform a user presence procedure to determine that a user is holding the gun, and the controller may cause the capacitor bank to be charged based on determining that the user is holding the gun. In some examples, the controller may cause the capacitor bank to be charged by forming a physical conductive path between the capacitor bank and an energy store (e.g., a battery cell or a battery pack).

At step 1410, the gun may identify a trigger break. The trigger break may be identified based on a trigger sensor, an output of a trigger sensor, or an analysis of an output of a trigger sensor. The trigger sensor may be located proximate to a trigger body, a trigger safety, or a trigger bar.

At step 1415, the gun may transmit a signal to signal cause the capacitor bank to discharge electric charge into an actuator mechanism. In some examples, the controller may cause the capacitor bank to discharge electric charge into the actuator mechanism by forming a physical conductive path between the capacitor bank and the actuator mechanism.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

EXAMPLES

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the techniques described herein relate to a method of operating a fire control system, the method including: charging a capacitor bank with electric charge until a stored voltage satisfies a voltage threshold, wherein the capacitor bank includes a plurality of capacitors that are connected in parallel; transmitting a first signal indicating a charge status of the capacitor bank to an electronic flip-flop in response to a determination that the stored voltage satisfies the voltage threshold; identifying a trigger break through real time analysis of an output generated by a trigger sensor of the fire control system, wherein the identifying the trigger break is based on the output indicating that trigger movement exceeds a displacement threshold; transmitting a second signal to the electronic flip-flop in response to the identifying the trigger break; and transmitting a third signal based on the first signal and the second signal, wherein the third signal causes: modification of the capacitor bank such that a first subset of the plurality of capacitors is connected in series with a second subset of the plurality of capacitors, and discharge of the electric charge from the capacitor bank, wherein the electric charge is directed through a solenoid of an actuator mechanism to cause successive displacement of the actuator mechanism, a sear, and a firing pin that strikes a cartridge primer cap so as to produce combustion, and wherein the combustion results in propulsion of a projectile through a barrel.

In some examples, the techniques described herein relate to a method of operating a fire control system, the method including: charging a capacitor bank with electric charge, wherein the capacitor bank includes a plurality of capacitors; identifying a trigger break through an analysis of an output generated by a trigger sensor of the fire control system; and transmitting a signal in response to the identifying the trigger break, wherein the signal causes: discharge of the electric charge from the capacitor bank such that electric charge is directed at an actuator mechanism to cause displacement of the actuator mechanism, wherein the displacement of the actuator mechanism results in propulsion of a projectile through a barrel.

In some examples, the techniques described herein relate to a method, further including: stacking, based on the signal, the capacitor bank such that a first subset of the plurality of capacitors is connected in series with a second subset of the plurality of capacitors.

In some examples, the techniques described herein relate to a method, wherein the plurality of capacitors are connected in parallel while the charging occurs, wherein the capacitor bank is associated with a first stored voltage when the plurality of capacitors are connected in parallel, and wherein the capacitor bank is associated with a second stored voltage that is approximately twice the first stored voltage when the first subset is connected in series with the second subset.

In some examples, the techniques described herein relate to a method, wherein the identifying the trigger break is in response to the output indicating that trigger movement exceeds a displacement threshold.

In some examples, the techniques described herein relate to a method, further including: identifying a user presence event based on an analysis of a second output produced by a presence sensor, wherein the transmitting the signal is based on the user presence event.

In some examples, the techniques described herein relate to a method, further including: transmitting a second signal in response to the user presence event to cause the fire control system to enter an armed state, wherein the fire control system is capable of firing projectiles while in the armed state, and wherein the transmitting the signal is further based on the second signal.

In some examples, the techniques described herein relate to a method further including: determining that the capacitor bank is charged based on a stored voltage satisfying a voltage threshold; and transmitting, based on the stored voltage satisfying the voltage threshold, a second signal indicating that the capacitor bank is charged.

In some examples, the techniques described herein relate to a method, wherein the transmitting the signal is based on the based on the voltage of the capacitor bank satisfying the voltage threshold.

In some examples, the techniques described herein relate to a method, further including: directing electric current to the actuator mechanism from a source separate from the capacitor bank, wherein the displacement of the actuator mechanism is based on the electric current.

In some examples, the techniques described herein relate to a method, further including: transmitting a second signal to reset the fire control system to cause the fire control system to be capable of firing an additional projectile.

In some examples, the techniques described herein relate to a method, further including: determining, based on the discharge of the electric charge from the capacitor bank, that the capacitor bank has discharged at least a threshold amount of electric charge, wherein the transmitting the second signal is in response to the determining that the capacitor bank has discharged at least the threshold amount of electric charge.

In some examples, the techniques described herein relate to a method, further including: determining that the capacitor bank has discharged at least the threshold amount of electric charge within a predetermined period of time following the transmitting the signal, wherein the transmitting the second signal is further in response to the determining that the capacitor bank has discharged at least the threshold amount of electric charge within the predetermined period of time.

In some examples, the techniques described herein relate to a method, further including: determining, based on a second output of an accelerometer, that the fire control system has undergone a recoil event associated with the propulsion of the projectile, wherein the transmitting the second signal is in response to the determining that the fire control system has undergone the recoil event.

In some examples, the techniques described herein relate to a method, further including: determining that the recoil event has occurred within a predetermined period of time following the transmitting the signal, wherein the transmitting the second signal is further in response to the determining that the recoil event has occurred within the predetermined period of time.

In some examples, the techniques described herein relate to a method, further including: recharging, based on the discharge of the electric charge from the capacitor bank, the capacitor bank while the plurality of capacitors are connected in parallel; and transmitting a second signal to cause the fire control system to enter a disarmed state, wherein the fire control system is incapable of firing projectiles while in the disarmed state.

In some examples, the techniques described herein relate to a method, further including: dissipating, in response to the second signal, the electric charge from the capacitor bank so as to reduce a stored voltage of the capacitor bank.

In some examples, the techniques described herein relate to a method, further including: connecting, in response to the second signal, the plurality of capacitors in parallel so as to reduce a stored voltage of the capacitor bank.

In some examples, the techniques described herein relate to a method, further including: encrypting the signal using an encryption key so as to produce an encrypted version of the signal, wherein the transmitting the signal includes transmitting the encrypted version of the signal.

In some examples, the techniques described herein relate to a fire control system including: an energy store that is capable of storing at least 500 milliampere hours of electric charge; a capacitor bank that is electronically coupled with the energy store, wherein the capacitor bank includes a plurality of capacitors; an actuator mechanism that is electronically coupled with the capacitor bank, wherein the actuator mechanism is operable to retain and release a firing mechanism; and a controller that is electronically coupled with the capacitor bank, wherein the controller is configured to (i) cause the energy store to charge the capacitor bank with electric charge and to (ii) cause the capacitor bank to discharge the electric charge into the actuator mechanism.

In some examples, the techniques described herein relate to a fire control system, wherein the controller includes: an electronic flip-flop configured to receive an input signal and transmit an output signal based on the input signal, wherein the output signal causes the energy store to charge the capacitor bank with the electric charge.

In some examples, the techniques described herein relate to a fire control system, wherein the controller includes: an electronic flip-flop configured to receive an input signal and transmit an output signal based on the input signal, wherein the output signal causes the capacitor bank to discharge the electric charge.

In some examples, the techniques described herein relate to a fire control system, further including: an electronic integrator configured to indicate whether the discharged electric charge exceeds a threshold amount of electric charge, wherein the controller is configured to generate an output signal based on the electronic integrator indicating that the discharged electric charge exceeds the threshold amount of electric charge.

In some examples, the techniques described herein relate to a fire control system, further including: an electronic timer configured to measure passage of time, wherein the controller is further configured to: determine, using the electronic timer, that the discharged electric charge exceeds the threshold amount of electric charge within a predetermined period of time following initiation of the discharge of the electric charge, wherein the output signal is based on the discharged electric charge exceeding the threshold amount of electric charge within the predetermined period of time.

In some examples, the techniques described herein relate to a fire control system, further including: an accelerometer configured to indicate whether measured movement satisfies a similarity condition with a predetermined movement signature indicating movement that is expected when firing a projectile, wherein the controller is configured to generate an output signal based on the accelerometer indicating that the measured movement satisfies the similarity condition with the predetermined movement signature.

In some examples, the techniques described herein relate to a fire control system, further including: an electronic timer configured to measure passage of time, wherein the controller is further configured to: determine, using the electronic timer, that the measured movement satisfies the similarity condition within a predetermined period of time following initiation of the discharge of the electric charge, wherein the output signal is based on the measured movement satisfying the similarity condition with the predetermined movement signature within the predetermined period of time.

In some examples, the techniques described herein relate to a fire control system, further including: a presence sensor that is electronically coupled with the controller, wherein the controller is further configured to cause the capacitor bank to discharge the electric charge into the actuator mechanism in response to the presence sensor generating an output indicating that a user is holding the fire control system or is holding a device that the fire control system is an aspect of.

In some examples, the techniques described herein relate to a fire control system, wherein the presence sensor includes a laser proximity sensor, a capacitive proximity sensor, an inductive proximity sensor, mechanical switch, a pressure sensor, an accelerometer, a gyroscope, a biometric sensor, or any combination thereof.

In some examples, the techniques described herein relate to a fire control system, further including: a processor that is electronically coupled with the controller, wherein the controller is configured to transmit, to the processor, a signal indicating that the capacitor bank has discharged the electric charge.

In some examples, the techniques described herein relate to a fire control system, wherein the processor is configured to store, based on the signal, a data value indicating that the capacitor bank has discharged the electric charge.

In some examples, the techniques described herein relate to a fire control system, wherein the processor is configured to perform a user authentication procedure to authenticate a user that is holding the fire control system or is holding a device that the fire control system is an aspect of.

In some examples, the techniques described herein relate to a fire control system, further including: a boost regulator configured to direct electric current at the actuator mechanism based on a stored voltage of the capacitor bank being less than a threshold voltage.

In some examples, the techniques described herein relate to a fire control system, wherein the plurality of capacitors are connected in parallel, and wherein the capacitor bank is configured to be charged with electric charge while the plurality of capacitors are connected in parallel.

In some examples, the techniques described herein relate to a fire control system, wherein a first subset of the plurality of capacitors is connected in series with a second subset of the plurality of capacitors, and wherein the capacitor bank is configured to discharge the electric charge while the first subset is connected in series with the second subset.

REMARKS

The Detailed Description provided herein, in connection with the drawings, describes example configurations and does not represent all the examples that may be implemented or that are within the scope of the claims. The term "example" used herein means "serving as an illustration or instance," and not "a preferred example."

The functions described herein may be implemented with a controller. A controller may include a flip-flop, a diode, a transistor, a resistor, a capacitor, a logic gate, an integrator, an operational amplifier, a comparator, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

Signals and information described herein may be represented using any of a variety of different technologies. For example, information, data, instructions, commands, signals, bits, symbols, and chips that may be referenced throughout the description may be represented by voltages, currents, electromagnetic waves, magnetic fields or particles, optical fields or particles, or any combination thereof.

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A fire control system comprising:

an energy store that is capable of storing at least 500 milliampere hours of electric charge;

a capacitor bank that is electronically coupled with the energy store, wherein the capacitor bank includes a plurality of capacitors;

an actuator mechanism that is electronically coupled with the capacitor bank, wherein the actuator mechanism is operable to retain and release a firing mechanism; and a controller that is electronically coupled with the capacitor bank, wherein the controller is configured to (i) cause the energy store to charge the capacitor bank with electric charge and to (ii) cause the capacitor bank to discharge the electric charge into the actuator mechanism, wherein the controller comprises an electronic flip-flop configured to receive an input signal and transmit an output signal based on the input signal, wherein the output signal causes the energy store to charge the capacitor bank with the electric charge.

2. The fire control system of claim 1, further comprising:

an electronic integrator configured to indicate whether the discharged electric charge exceeds a threshold amount of electric charge, wherein the controller is configured to generate an output signal based on the electronic integrator indicating that the discharged electric charge exceeds the threshold amount of electric charge.

3. The fire control system of claim 2, further comprising:

an electronic timer configured to measure passage of time, wherein the controller is further configured to:

determine, using the electronic timer, that the discharged electric charge exceeds the threshold amount of electric charge within a predetermined period of time following initiation of the discharge of the electric charge, wherein the output signal is based on the discharged electric charge exceeding the threshold amount of electric charge within the predetermined period of time.

4. The fire control system of claim 1, further comprising:

a processor that is electronically coupled with the controller, wherein the controller is configured to transmit, to the processor, a signal indicating that the capacitor bank has discharged the electric charge.

5. The fire control system of claim 4, wherein the processor is configured to store, based on the signal, a data value indicating that the capacitor bank has discharged the electric charge.

6. The fire control system of claim 1, wherein the plurality of capacitors are connected in parallel, and wherein the capacitor bank is configured to be charged with electric charge while the plurality of capacitors are connected in parallel.

7. The fire control system of claim 1, wherein a first subset of the plurality of capacitors is connected in series with a second subset of the plurality of capacitors, and wherein the capacitor bank is configured to discharge the electric charge while the first subset is connected in series with the second subset.

8. A fire control system comprising:

an energy store that is capable of storing at least 500 milliampere hours of electric charge;

a capacitor bank that is electronically coupled with the energy store, wherein the capacitor bank includes a plurality of capacitors;

an actuator mechanism that is electronically coupled with the capacitor bank, wherein the actuator mechanism is operable to retain and release a firing mechanism; and a controller that is electronically coupled with the capacitor bank, wherein the controller is configured to (i) cause the energy store to charge the capacitor bank with electric charge and to (ii) cause the capacitor bank to discharge the electric charge into the actuator mechanism, wherein the controller comprises:

an electronic flip-flop configured to receive an input signal and transmit an output signal based on the input signal, wherein the output signal causes the capacitor bank to discharge the electric charge.

9. A fire control system comprising:

an energy store that is capable of storing at least 500 milliampere hours of electric charge;

a capacitor bank that is electronically coupled with the energy store, wherein the capacitor bank includes a plurality of capacitors;

an actuator mechanism that is electronically coupled with the capacitor bank, wherein the actuator mechanism is operable to retain and release a firing mechanism;

an accelerometer configured to indicate whether measured movement satisfies a similarity condition with a predetermined movement signature indicating movement that is expected when firing a projectile; and a controller that is electronically coupled with the capacitor bank, wherein the controller is configured to (i) cause the energy store to charge the capacitor bank with electric charge, (ii) cause the capacitor bank to discharge the electric charge into the actuator mechanism, and (iii) generate an output signal based on the accelerometer indicating that the measured movement satisfies the similarity condition with the predetermined movement signature.

10. The fire control system of claim 9, further comprising:

an electronic timer configured to measure passage of time, wherein the controller is further configured to:

determine, using the electronic timer, that the measured movement satisfies the similarity condition within a predetermined period of time following initiation of the discharge of the electric charge, wherein the output signal is based on the measured movement satisfying the similarity condition with the predetermined movement signature within the predetermined period of time.

11. A fire control system comprising:

an energy store that is capable of storing at least 500 milliampere hours of electric charge;

a capacitor bank that is electronically coupled with the energy store, wherein the capacitor bank includes a plurality of capacitors;

an actuator mechanism that is electronically coupled with the capacitor bank, wherein the actuator mechanism is operable to retain and release a firing mechanism;

a presence sensor; and a controller that is electronically coupled with the capacitor bank and the presence sensor, wherein the controller is configured to (i) cause the energy store to charge the capacitor bank with electric charge and (ii) cause the capacitor bank to discharge the electric charge into the actuator mechanism in response to the presence sensor generating an output indicating that a user is holding the fire control system or is holding a device that the fire control system is an aspect of.

12. The fire control system of claim 11, wherein the presence sensor includes a laser proximity sensor, a capacitive proximity sensor, an inductive proximity sensor, mechanical switch, a pressure sensor, an accelerometer, a gyroscope, a biometric sensor, or any combination thereof.

13. A fire control system comprising:

an energy store that is capable of storing at least 500 milliampere hours of electric charge;

a capacitor bank that is electronically coupled with the energy store, wherein the capacitor bank includes a plurality of capacitors;

an actuator mechanism that is electronically coupled with the capacitor bank, wherein the actuator mechanism is operable to retain and release a firing mechanism; and a controller that is electronically coupled with the capacitor bank, wherein the controller is configured to cause the energy store to charge the capacitor bank with electric charge, and cause the capacitor bank to discharge the electric charge into the actuator mechanism; and a processor that electrically coupled with the controller, wherein the controller is configured to receive, from the processor, a signal indicating that the capacitor bank has discharged the electric charge, and perform a user authentication procedure to authenticate a user that is holding the fire control system or is holding a device that the fire control system is an aspect of.

14. A fire control system comprising:

an energy store that is capable of storing at least 500 milliampere hours of electric charge;

a capacitor bank that is electronically coupled with the energy store, wherein the capacitor bank includes a plurality of capacitors;

an actuator mechanism that is electronically coupled with the capacitor bank, wherein the actuator mechanism is operable to retain and release a firing mechanism;

a boost regulator configured to direct electric current at the actuator mechanism based on a stored voltage of the capacitor bank being less than a threshold voltage; and a controller that is electronically coupled with the capacitor bank, wherein the controller is configured to (i) cause the energy store to charge the capacitor bank with electric charge and to (ii) cause the capacitor bank to discharge the electric charge into the actuator mechanism.

* * * * *